US007224329B1

(12) United States Patent
Onozawa et al.

(10) Patent No.: US 7,224,329 B1
(45) Date of Patent: May 29, 2007

(54) PLASMA DISPLAY APPARATUS AND MANUFACTURING METHOD

(75) Inventors: Makoto Onozawa, Kawasaki (JP); Michitaka Ohsawa, Kawasaki (JP); Kenji Ishiwata, Kawasaki (JP); Takeshi Kuwahara, Kawasaki (JP); Yoshikazu Kanazawa, Kawasaki (JP); Kenji Kimura, Kawasaki (JP); Hidenori Ohnuki, Kawasaki (JP); Taizo Ohno, Higashimorokata (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 71 days.

(21) Appl. No.: 09/702,889

(22) Filed: Nov. 1, 2000

(30) Foreign Application Priority Data

Mar. 29, 2000 (JP) ..... 2000-092131

(51) Int. Cl.
*G09G 3/10* (2006.01)

(52) U.S. Cl. ..... 345/60; 345/41; 345/37

(58) Field of Classification Search ..... 345/55, 345/60, 68, 67, 62, 78, 51, 211, 212
See application file for complete search history.

(56) References Cited

U.S. PATENT DOCUMENTS 4,067,047 A * 1/1978 Ryan ..... 348/797
4,594,588 A * 6/1986 Barclay et al. ..... 345/68
5,369,338 A * 11/1994 Kim ..... 315/169.4
5,438,290 A 8/1995 Tanaka
5,642,018 A * 6/1997 Marcotte ..... 315/169.4
5,786,794 A 7/1998 Kishi et al.
5,828,353 A 10/1998 Kishi et al.
5,844,369 A * 12/1998 Yoshizako et al. ..... 315/111.21
5,994,929 A 11/1999 Sano et al.
6,011,355 A * 1/2000 Nagai ..... 315/167.3
6,084,558 A 7/2000 Setoguchi et al.
6,097,214 A 8/2000 Troussel et al.
6,111,556 A * 8/2000 Moon ..... 345/60

(Continued)

FOREIGN PATENT DOCUMENTS

EP 0 762 373 3/1997

(Continued)

OTHER PUBLICATIONS

Patent Abstracts of Japan for Publication No. 09160525, dated Jun. 20, 1997.

(Continued)

*Primary Examiner*—Guy Lamarre
*Assistant Examiner*—Fritz Alphonse
(74) *Attorney, Agent, or Firm*—Staas & Halsey LLP

(57) ABSTRACT

A PDP apparatus of low power consumption and without erroneous malfunctions is equipped with a sustaining circuit that prevents an on/off timing shift and deterioration of a sustaining pulse produced thereby. Phase adjusting circuits, which adjust the timing of the changing edge of the sustaining pulse, are provided for the sustaining circuit; the power recovery circuit is of improved efficiency; and power consumption is reduced by optimizing the timing of a changing edge of the sustaining pulse The circuit devices used in the sustaining circuits are classified according to delay times and sets of the circuit devices are selected so that the timing of a changing edge of the sustaining pulse falls within a predetermined allowance, and the selected sets of the circuit devices are set to the PDP.

15 Claims, 19 Drawing Sheets

U.S. PATENT DOCUMENTS

| | | | | |
|---|---|---|---|---|
| 6,160,530 | A * | 12/2000 | Makino | 345/60 |
| 6,211,867 | B1 * | 4/2001 | Kim | 345/211 |
| 6,404,411 | B1 * | 6/2002 | Masuda et al. | 345/66 |
| 6,414,653 | B1 | 7/2002 | Kobayashi | |
| 6,489,939 | B1 | 12/2002 | Asao et al. | |

FOREIGN PATENT DOCUMENTS

| | | |
|---|---|---|
| JP | 7-160219 | 6/1985 |
| JP | 4-181809 | 6/1992 |
| JP | 9-34396 | 2/1997 |
| JP | 9-160525 | 6/1997 |
| JP | 9-325735 | 12/1997 |
| JP | 10-301530 | 11/1998 |
| JP | 11-15436 | 1/1999 |
| JP | 11-143427 | 5/1999 |
| JP | 11-282416 | 10/1999 |
| JP | 11-338416 | 10/1999 |
| JP | 11-327505 | 11/1999 |
| JP | 11-338414 | 12/1999 |
| KR | 10-0222203 | 7/1999 |
| WO | WO 99/60606 | 11/1999 |

OTHER PUBLICATIONS

Japanese Office Action dated Jul. 6, 2004.
European Office Action dated Apr. 19, 2006 of Application No. 00 309 848.0.

* cited by examiner

ODD FIELD

EVEN FIELD

PLASMA DISPLAY APPARATUS AND MANUFACTURING METHOD

BACKGROUND OF THE INVENTION

The present invention relates to a plasma display apparatus and a method of manufacturing the same. More particularly, the present invention relates to a plasma display apparatus equipped with a power recovery circuit in a sustaining circuit that reduces power consumption, a method of driving a plasma panel display employing the ALIS (Alternate Lighting of Surfaces) system, in which plural first and second electrodes are arranged adjacently and display lines are formed between every pair of adjacent electrodes, and a plasma display apparatus employing the same.

The plasma display panel (PDP) has good visibility because it generates its own light, is thin and can be made with large and high-speed display, therefore, it is attracting interest as a replacement for the CRT display. Since the structure of a typical PDP has been disclosed in Japanese Unexamined Patent Publication (Kokai) No. 7-160219, Japanese Unexamined Patent Publication (Kokai) No. 9-160525, and Japanese Unexamined Patent Publication (Kokai) No. 9-325735, a detailed explanation is omitted here and, instead, only points relating directly to the present invention are explained.

FIG. 1 is a block diagram showing a total structure of a general PDP apparatus. In a PDP 10, n X electrodes 11 and Y electrodes 12 are arranged in adjacent and alternating parallel relationships, forming n pairs, each pair of an X electrode 11 and a Y electrode 12, and light is emitted for display between the X electrode 11 and Y electrode 12 of each pair. Y electrodes and X electrodes are called display electrodes and are also called sustaining electrodes. Address electrodes 13 are provided in the direction that runs at a right angle to the direction in which the display electrodes extend, and display cells are formed at crossings of the address electrodes and pairs of X electrode 11 and Y electrode 12.

The Y electrodes 12 are connected to a scan driver 14. The scan driver 14 is equipped with switches 16, the number of which being equal to that of the Y electrodes, and the switches are switched so that scan pulses from a scan signal generating circuit 15 are applied sequentially during the address period, and sustaining pulses from a Y sustaining circuit 19 are applied simultaneously during the sustaining discharge period. The X electrodes 11 are connected commonly to an X sustaining circuit 18, and the address electrodes 13 are connected to an address driver circuit 17. In an image signal processing circuit 21, image signals are converted so as suit the operation in the PDP apparatus, and are then supplied to the address driver circuit 17. A drive control circuit 20 generates and supplies signals that control each part of the PDP apparatus.

FIG. 2 is a time chart showing drive signals of the PDP apparatus. In the PDP apparatus, a display frame is refreshed at predetermined intervals, and a display period is called a field. In order to realize a gray scale, a field is divided into plural subfields and the subfields that emit light are selected for each display cell. Each subfield consists of the reset period during which all display cells are initialized, the address period during which all display cells are put into the status corresponding to the display image, and the sustaining discharge period during which each display cell emits light according to the set status. During the sustaining discharge period, sustaining pulses are applied to X electrodes and Y electrodes alternately and sustaining discharges are performed in the display cell specified to emit light during the address period, resulting in light emission for display.

In the PDP apparatus, it is necessary to apply a voltage of about 200 V at maximum between electrodes as a high frequency pulse during the sustaining discharge period, and the width of a pulse is a few microseconds in a system in which the gray scale is realized by the representation of subfields. Since such a high voltage and a high frequency signal are required to drive a PDP, the power consumption of a general PDP apparatus is large and reduction in power consumption is demanded. In U.S. Pat. No. 4,070,663, the control method to suppress the power consumption of the capacitive display unit such as an EL (Electro-Luminescence) apparatus, in which an inductor device is provided to form a resonant circuit with the capacitor of the display unit, has been disclosed. In addition, the sustaining discharge driver and the address driver for the PDP panel equipped with a power recovery circuit consisting of inductor devices have been disclosed in U.S. Pat. No. 4,866,349 and U.S. Pat. No. 5,081,400. Moreover, in Japanese Unexamined Patent Publication (Kokai) No. 7-160219, the construction of a three-electrode type display unit equipped with two inductors provided to the Y electrode, one of which forms a recovery circuit to recover the applied power while the Y electrode is switched from a high voltage state to a low voltage state, and the other inductor forms an application path to apply the accumulated power while the Y electrode is switched from a low voltage state to a high voltage state.

FIG. 3 is a schematic showing an example of a typical construction of a sustaining circuit equipped with a power recovery circuit, in which a recovery circuit to recover power and an application circuit to apply the accumulated power is separated. Circuits to generate signals V1 to V4 are also provided, but they are omitted here. Reference code Cp refers to a drive capacitance of a display cell, formed by the X electrode and Y electrode of a PDP. Though a sustaining circuit of one of the electrodes is shown here, the other electrode is also connected to a similar sustaining circuit. In the circuit in FIG. 3, the part consisting of output devices (transistors) 31 and 33, and drive circuits 32 and 34 is a sustaining circuit without a power recovery circuit, and the part consisting of output devices (transistors) 37 and 40, drive circuits 38 and 41, inductance devices 35 and 43, capacitor 39, and diodes 36 and 42, is a power recovery circuit. The signals V1 and V2 are supplied to the drive circuits 32 and 34, respectively, and the signals VG1 and VG2 output therefrom are supplied to the gates of the output devices (transistors) 31 and 33. When the signal V1 is "High (H)", the output device 31 turns on and an H level signal is applied to the electrode. At this time, the signal V2 is "Low (L)", and the output device 33 is off. Immediately after the signal V1 turns to L and the output device 31 turns off, the signal V2 turns to H and the output device 33 turns on, and the ground level is applied to the electrode.

In the sustaining circuit with the power recovery circuit, when sustaining pulses are applied, before the signal V1 turns to H the signal V2 turns to L, and after the output device 33 turns off the signal V3 turns to H, the output device 40 turns on, a resonant circuit is formed by the capacitor 39, diode 42, inductor 43, and capacitor Cp, and the power accumulated in the capacitor 39 is supplied to the electrode, causing the potential of the electrode to rise. Just before the increase of the potential is completed, the signal V3 turns to L and the output device 40 turns off, then the signal V1 turns to H and the output device 31 turns off, thus the potential of the electrode is fixed to Vs. When the application of sustaining pulses is terminated, the signal V1 turns to L first and after the output device 31 turns off, the signal V4 turns to H, the output device 37 turns on, and a resonant circuit is formed by the capacitor 39, diode 36, inductor 35, and capacitor Cp, and the power accumulated in the capacitor Cp is supplied to the capacitor 39, thus the voltage of the capacitor 39 is raised. Therefore, the power accumulated in the capacitor Cp is recovered to the capacitor 39 by the sustaining pulses applied to the electrode. Just before the reduction in potential of the electrode is completed, the signal V4 turns to L, the output device 37 turns off, then the signal V2 turns to H, the output device 33 turns on, and the potential of the electrode is fixed to the ground level. During the sustaining discharge period, the above-mentioned operation is repeated a number of times equal to that of the sustaining pulses. In the structure mentioned above, the power consumption caused by the sustaining discharge can be suppressed.

On the other hand, a higher precision of the display is required for the PDP apparatus, and the system in which light is emitted for display between every adjacent display electrode has been disclosed in Japanese Patent No. 2801893. This system is called the ALIS system and is called the same here. Since the detail of the structure of the ALIS system has been disclosed in Japanese Patent No. 2801893, only the points relating to the present invention are explained here.

FIG. 4 is a general block diagram of a PDP employing the ALIS system. As shown schematically, in the PDP employing the ALIS system, n Y electrodes (second electrodes) 12-O and 12-E and n+1 X electrodes (first electrodes) 11-O and 11-E are arranged adjacently by turns and light is emitted between every adjacent display electrode (Y electrode and X electrode). Therefore, 2n+1 display electrodes form 2n display lines. This means that the precision can be doubled with the same number of the display electrodes as that in FIG. 1, in the ALIS system. The ALIS system is also characterized by a high luminance because the discharge space can be used efficiently without any waste and a high opening ratio can be obtained to give a small loss of light due to electrodes or the like. Light is emitted between every adjacent display electrode for display in the ALIS system, but it is impossible to cause all discharges to occur at the same time. Therefore, so-called interlaced scanning, in which odd-numbered lines and even-numbered lines are used in a time-shared manner for display, is employed. In the odd field, odd-numbered display lines are used for display, and even-numbered display lines are used for display in the even field, and the display combining the odd field and the even field is obtained as a total display.

Y electrodes are connected to the scan driver 14. The scan driver 14 is equipped with switches 16, and the switches are switched so that scan pulses are applied sequentially during the address period, and in the sustaining discharge period, the odd-numbered Y electrode 12-O is connected to the first Y sustaining circuit 19-O and the even-numbered Y electrode 12-E is connected to the second Y sustaining circuit 19-E. The odd-numbered X electrode 11-O is connected to the first X sustaining circuit 18-O, and the even-numbered X electrode 11-E is connected to the second X sustaining circuit 18-E. The address electrodes 13 are connected to the address driver circuit 17. The image signal processing circuit 21 and the drive control circuit 20 work in the similar manner as explained in FIG. 1.

FIGS. 5A and 5B show drive signals during the sustaining discharge period in the ALIS system. FIG. 5A shows waveforms in the odd field and FIG. 5B shows those in the even field. In the odd field, a voltage Vs is applied to the electrodes Y1 and X2, X1 and Y2 are grounded, and discharge is caused to occur between X1 and Y1, and X2 and Y2, that is, at the odd-numbered display lines. At this time, the voltage difference between Y1 and X2, which form the even-numbered display line, is zero and no discharge is caused to occur. Similarly, in the even field, a voltage Vs is applied to the electrodes X1 and Y2, Y1 and X2 are grounded, and discharge is caused to occur between Y1 and X2, and Y2 and X1, that is, at the even-numbered display lines. The explanation about the drive signals during the reset period and the address period is omitted.

In the power recovery circuit shown in FIG. 3, it is essential to perform recovery and application of power efficiently, and achievement of a high rate of power recovery is expected. The achievement of a high rate of power recovery is influenced by the on/off timing of the output devices 31, 33, 37, and 40. FIGS. 6A and 6B show the influence, FIG. 6A shows a case where the clamp timing is advanced and FIG. 6B shows a case where the clamp timing is delayed.

As explained above, when sustaining pulses are applied, the output device 40 turns on and the power accumulated in the capacitor 39 is supplied to the electrode, and just before the increase of the potential of the electrode is completed, the signal V3 turns to L, the output device 40 turns off, and at the same time, the signal V1 turns to H, the output device 31 turns on, thus the potential of the electrode is clamped to Vs. As shown in FIG. 6A, however, if the output device 31 turns on before the output device 40 turns off, the electrode is connected to the power source of voltage Vs halfway while the potential of the electrode is being raised by the power accumulated in the capacitor 39 because of the turn-on of the output device 31 and, therefore, the power for the rest of the process is supplied from the power source and a part of the power accumulated in the capacitor 39 is wasted and not utilized. Similarly, when the application of sustaining pulses is terminated, if the output device 37 turns on to cause the output device 33 to turn on while the power is being recovered into the capacitor 39, the electrode is clamped to the ground level before the power is recovered sufficiently, therefore the recovery of power is not completed.

Moreover, as shown in FIG. 6B, when the sustaining pulses are applied, if the output device 31 turns on after the output device 40 turns off, the increase of the potential of the electrode by the power accumulated in the capacitor 39 is terminated, and since the output device 31 turns on after the potential of the electrode begins to drop, and the electrode is clamped to the power source of voltage Vs, it is required to raise the dropped potential, resulting in excessive power consumption. Similarly, when the application of the sustaining pulses is terminated, if the output device 33 turns on after the output device 37 turns off, the electrode is clamped to the ground level after the potential, which has been once lowered, begins to rise again, therefore it is required to reduce the increased potential, resulting in excessive power consumption.

As explained above, if the on/off timing of the output devices 31, 33, 37, and 40 in the sustaining circuit is shifted, a problem occurs that the power recovery rate is reduced and the power consumption increases. The on/off timing of output devices 31, 33, 37, and 40 is the timing of the change of the signals V1, V2, V3, and V4 plus delay times of the drive circuits 32, 34, 38, and 41, and further plus delay times of the output devices 31, 33, 37, and 40. Though the timing of change of the signals V1, V2, V3, and V4 can be determined with a comparatively high precision, the delay times of the drive circuits 32, 34, 38, and 41, and those of the output devices 31, 33, 37, and 40 are dispersed depending on variations in characteristics of the devices used. Therefore, the power recovery rate for each PDP apparatus is dispersed, the power recovery rate is lower than that in an ideal case, and a problem occurs that the power consumption increases.

As explained above, if the variations in delay times of the circuit devices cause the shapes and timings of the sustaining pulses to change, the possibility of a malfunction is increased. In general, the difference $\Delta$ Vs, which is called the operation margin, of the maximum value Vs (max) and the minimum value Vs (min) in the operational range of the operating voltage Vs is reduced when the delay times of the circuit devices are dispersed and the shapes and timing of the sustaining pulses are altered. This means a deterioration in the operation stability of the apparatus.

In the ALIS system, discharge for light emission does not take place between adjacent electrodes to which the same voltage is applied, respectively. If, however, the timing of application is shifted, a problem may come up that discharge for light emission takes place temporarily at the display lines not for display and wall-charge accumulated during the address period decreases, resulting in an abnormal display. For example, in FIG. 5A, if sustaining pulses are applied to Y1 electrodes and to X2 electrodes after a delay, a situation may occur, temporarily, in which a Y1 electrode is H and at the same time that an X2 electrode is L, and erroneous discharge for light emission may take place between a Y1 electrode and an X2 electrode. Though such erroneous discharge for light emission ceases when sustaining pulses are applied to X2 electrode, the wall-charges of Y1 electrode and X2 electrode decrease and the normal light emission for display may be impeded.

As explained above, there has been a problem that power consumption is increased and a malfunction occurs when the time delays in each circuit device in the sustaining circuit are dispersed and therefore, the on/off timing and the shapes of the sustaining pulses are shifted or changed.

SUMMARY OF THE INVENTION

The present invention has been developed to solve these problems and the objective of the present invention is to realize a sustaining circuit in which the on/off timing and the shapes of the sustaining pulses are not shifted or changed, and a PDP apparatus with low power consumption and free from malfunctions is provided.

To realize the above-mentioned objective, the PDP apparatus of the present invention is provided with a sustaining circuit having phase adjusting circuits that adjust the timing of the changing edge of the sustaining pulse. By adjusting the phase adjusting circuits and optimizing the state of the timing of the changing edge of the sustaining pulse, the power recovery circuit can work efficiently and the power consumption will be reduced. In addition, since the on/off timing of the sustaining pulses applied from each sustaining circuit are optimized to each other, malfunctions or erroneous discharge can be avoided.

It is particularly effective if the present invention is employed in a PDP apparatus equipped with a sustaining circuit having a power recovery circuit, or one employing an ALIS system.

In the case of the sustaining circuit equipped with a power recovery circuit, as shown in FIG. 3, it is required for the phase adjusting circuit to be able to adjust the time differences from turn-on of the third output device and to that of the first output device, and from turn-on of the fourth output device and to that of the second output device.

In the case of the ALIS system as shown in FIG. 4, it is required to be able to adjust the timing of the sustaining pulses applied between adjacent electrodes to prevent erroneous discharge. For example, the difference of the rise timing or the fall timing between the sustaining pulse output by the first X sustaining circuit and that of the first or the second Y sustaining circuit, and the difference of the rise timing or the fall timing between the sustaining pulse output by the second X sustaining circuit and that of the first or the second Y sustaining circuit are adjusted to be lower than a predetermined value, for example, within ±30 ns.

When the adjustment is performed using the phase adjusting circuit mounted to the PDP, the optimized state can be obtained according to the actual capacity of the electrode of the PDP.

In addition, it will also be preferable to mount the set of the selected circuit devices after selecting the combination of the circuit devices, which have been classified in advance according to the delay times and are to be used in the sustaining circuit, so that the timing of the changing edge of the sustaining pulse falls within a predetermined allowance.

BRIEF DESCRIPTION OF THE DRAWINGS

The features and advantages of the invention will be more clearly understood from the following description taken in conjunction with the accompanying drawings in which.

DESCRIPTION OF THE PREFERRED EMBODIMENTS

Figure 7:
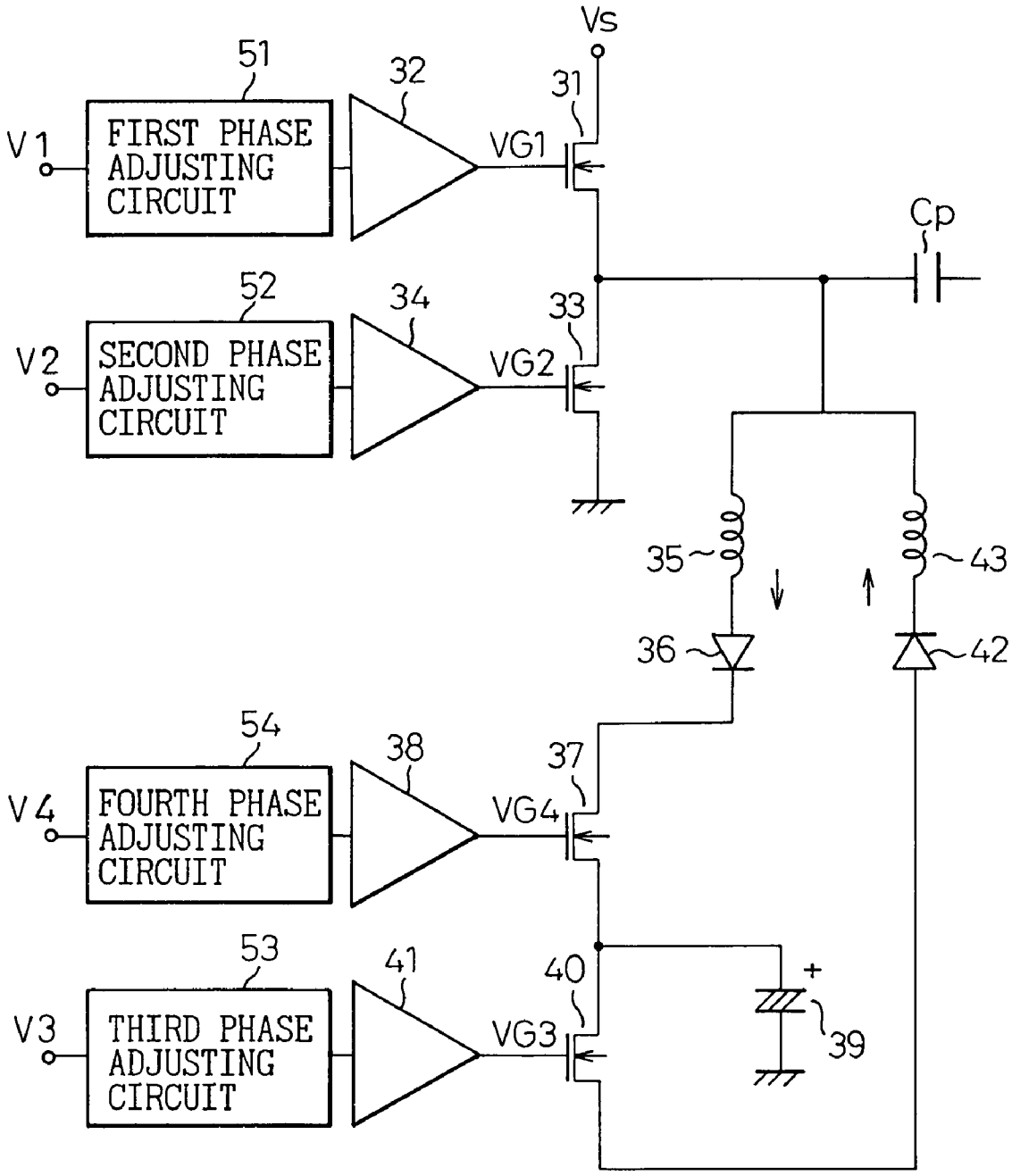
FIG. 7 is a schematic showing the structure of the sustaining circuit in the embodiment of the present invention.

The embodiments in which the ALIS system of the present invention is applied to the PDP apparatus are described below. The PDP apparatus of the present invention has the general structure as shown in FIG. 4, and the first and the second X sustaining circuits 18-O and 18-E, and the first and the second Y sustaining circuits 19-O and 19-E have the structures as shown in FIG. 7. Similarly, as in FIG. 3, the circuits that generate the signals V1 through V4 are not shown.

Figure 1:
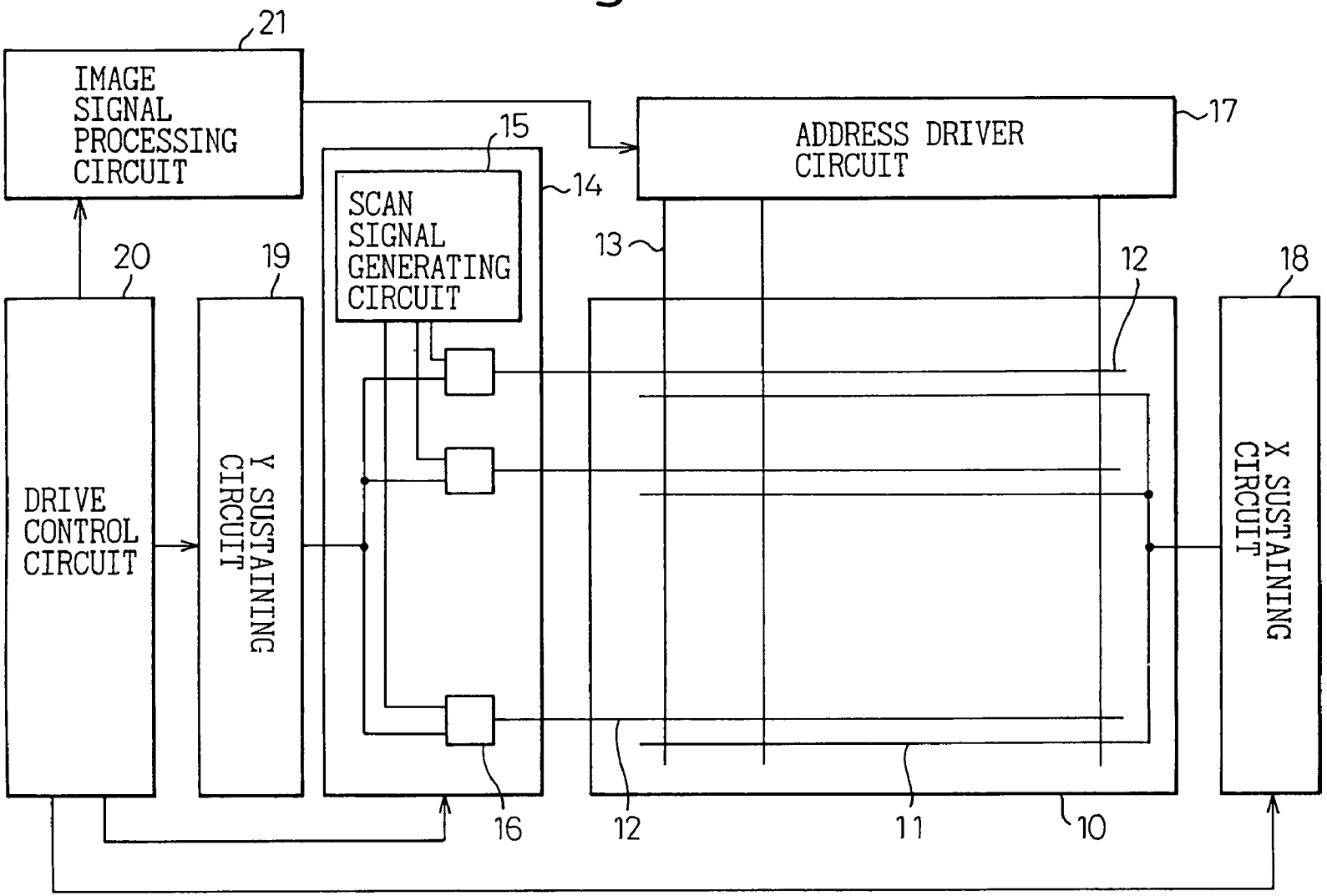
FIG. 1 is a block diagram showing the general structure of the PDP apparatus.
Figure 2:
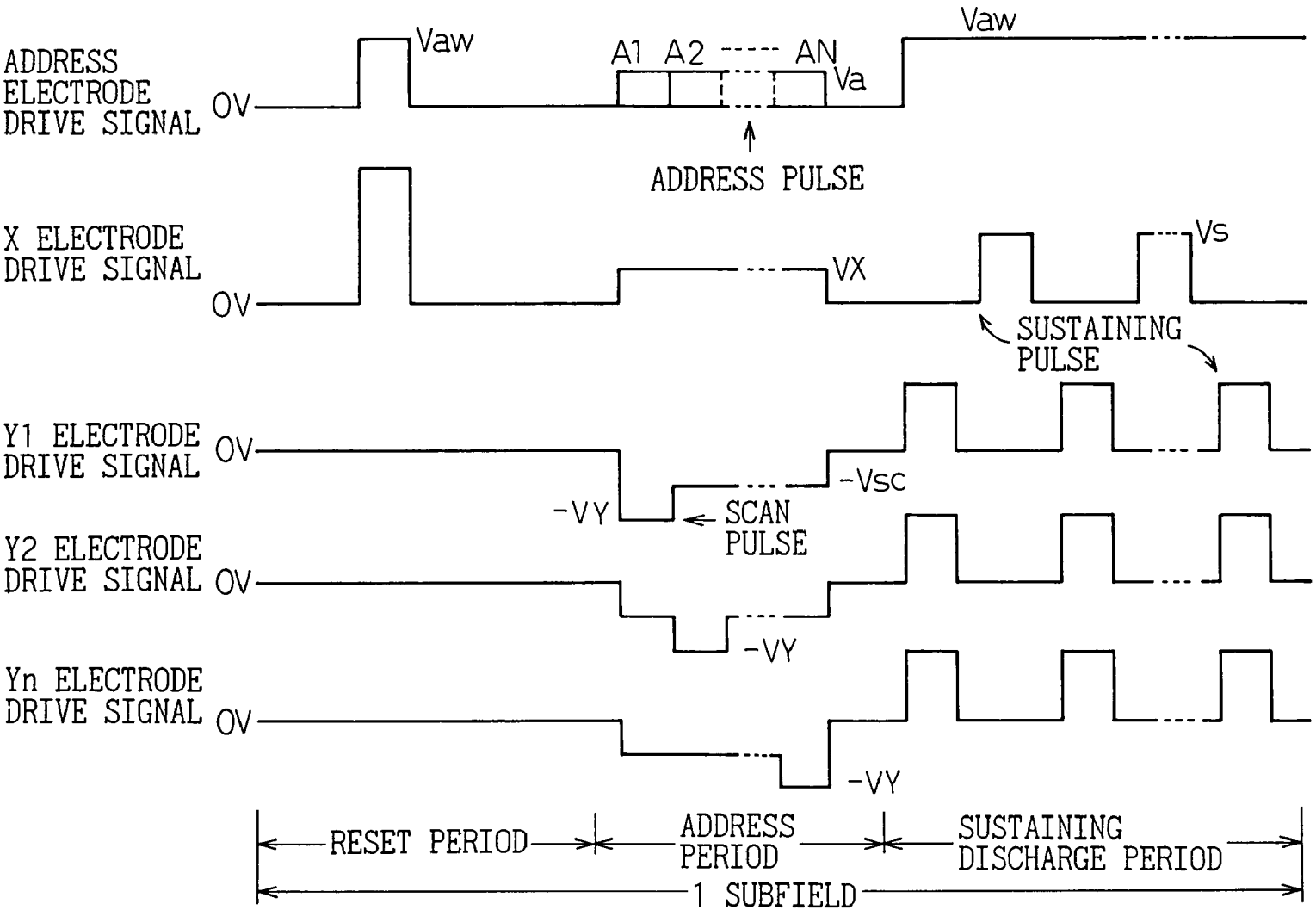
FIG. 2 is a time chart showing the drive signals of the PDP apparatus.
Figure 3:
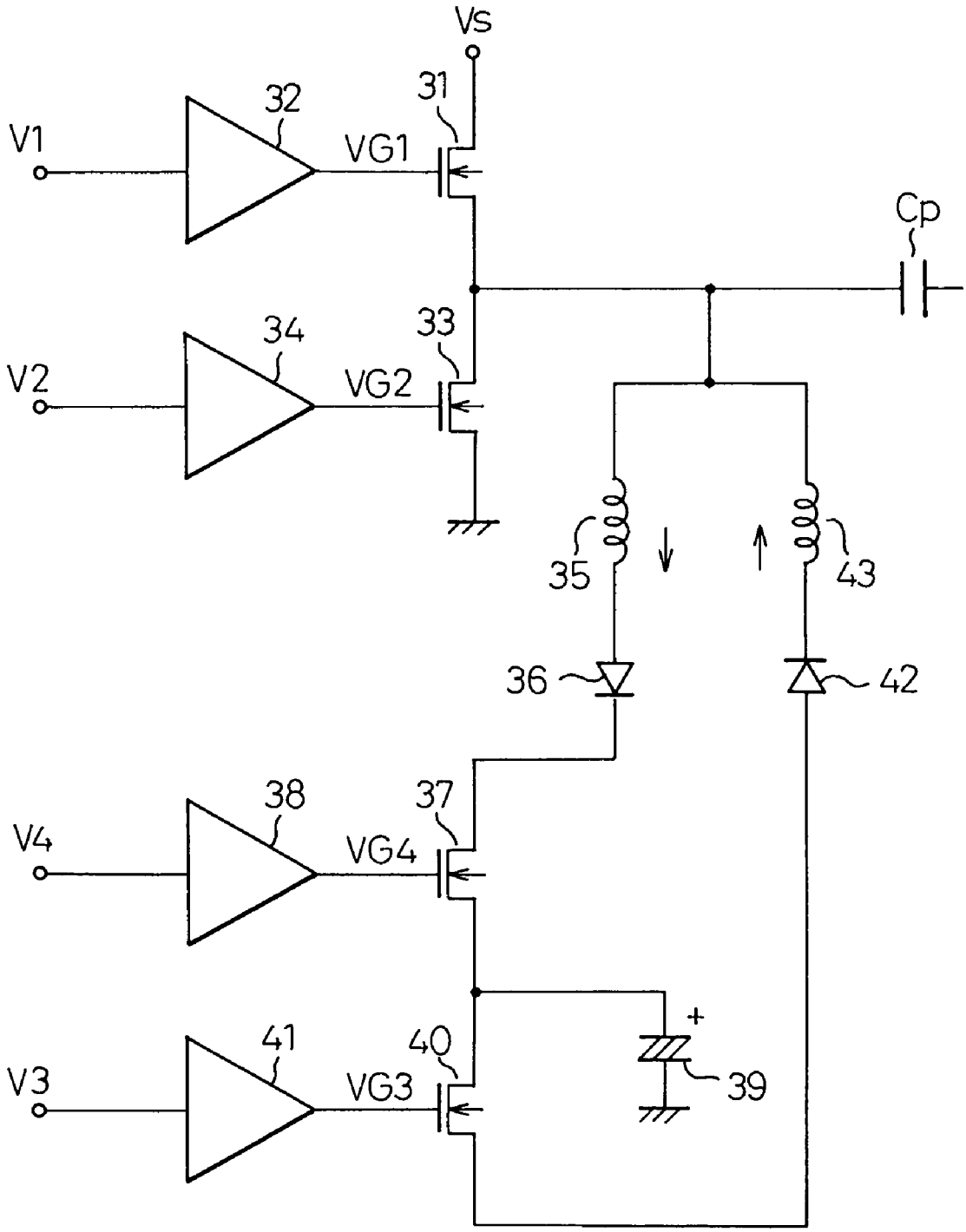
FIG. 3 is a schematic showing an example of the structure of the sustaining circuit equipped with the power recovery circuit.
Figure 4:
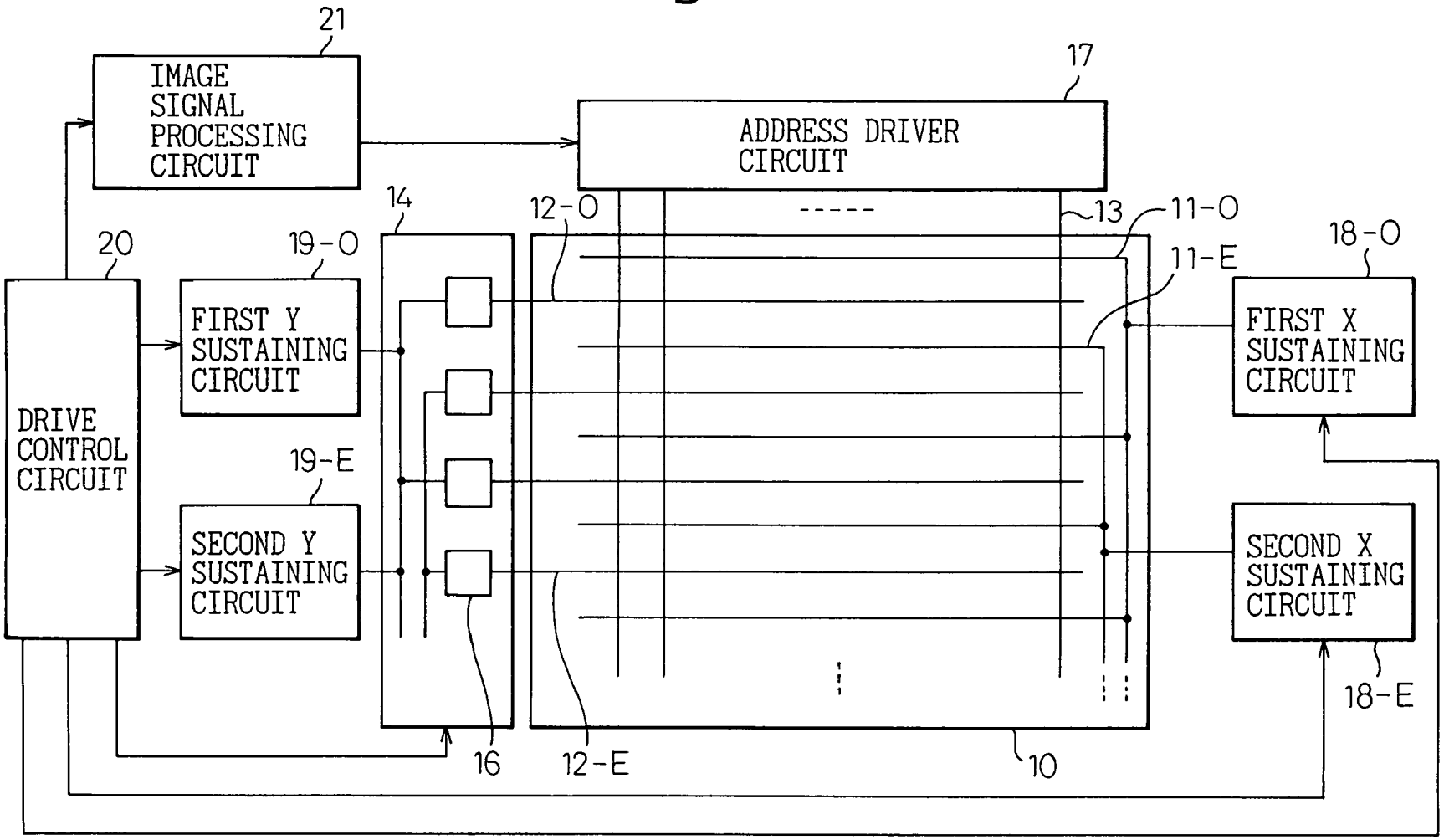
FIG. 4 is a block diagram showing the general structure of the PDP apparatus employing the ALIS system.
Figure 5A:
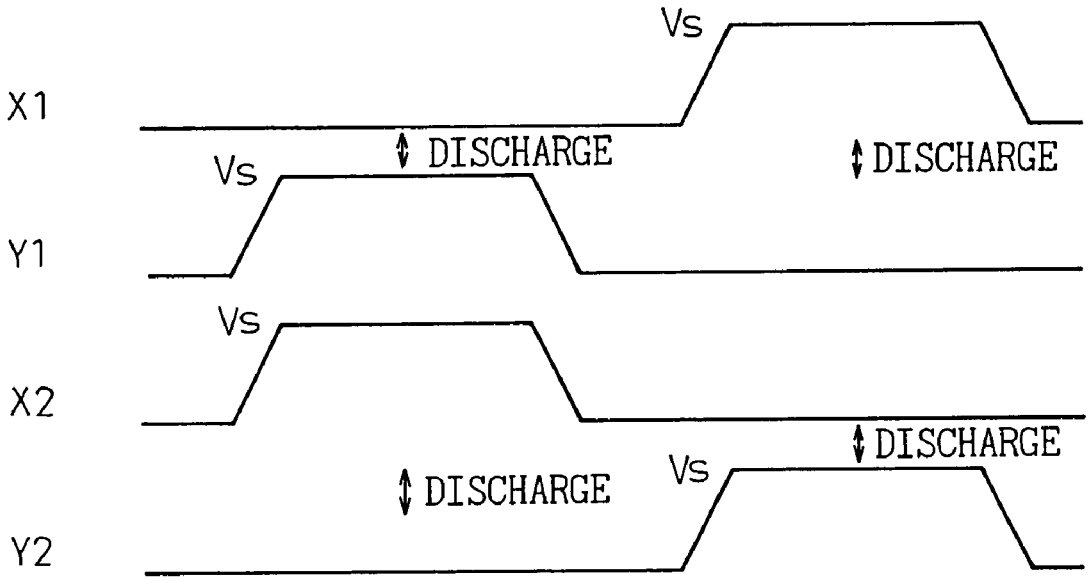
FIGS. 5A and 5B show time charts showing the drive signals during the sustaining discharge period in the ALIS system.
Figure 5B:
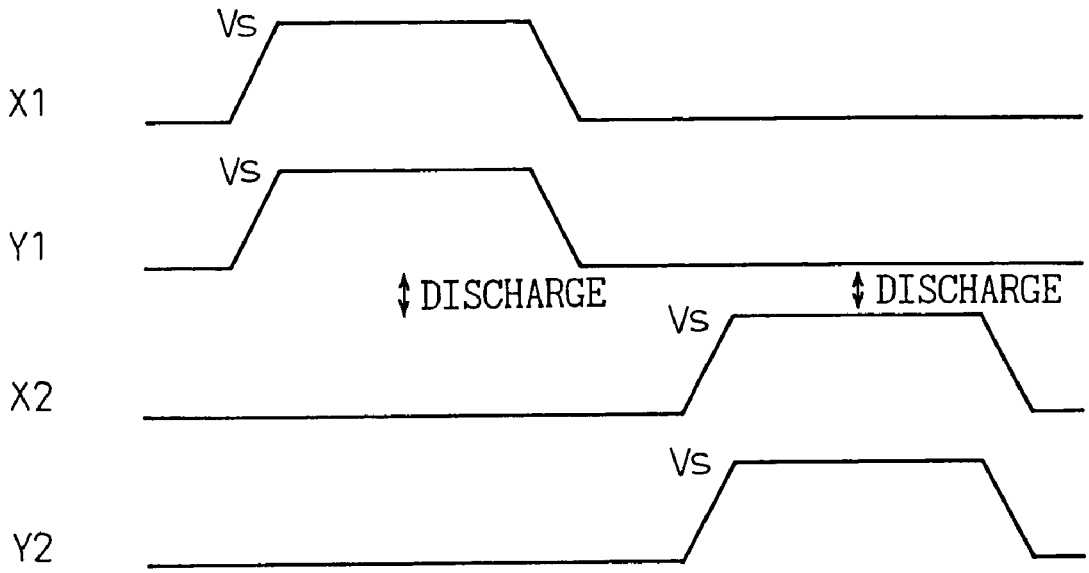
Figure 6A:
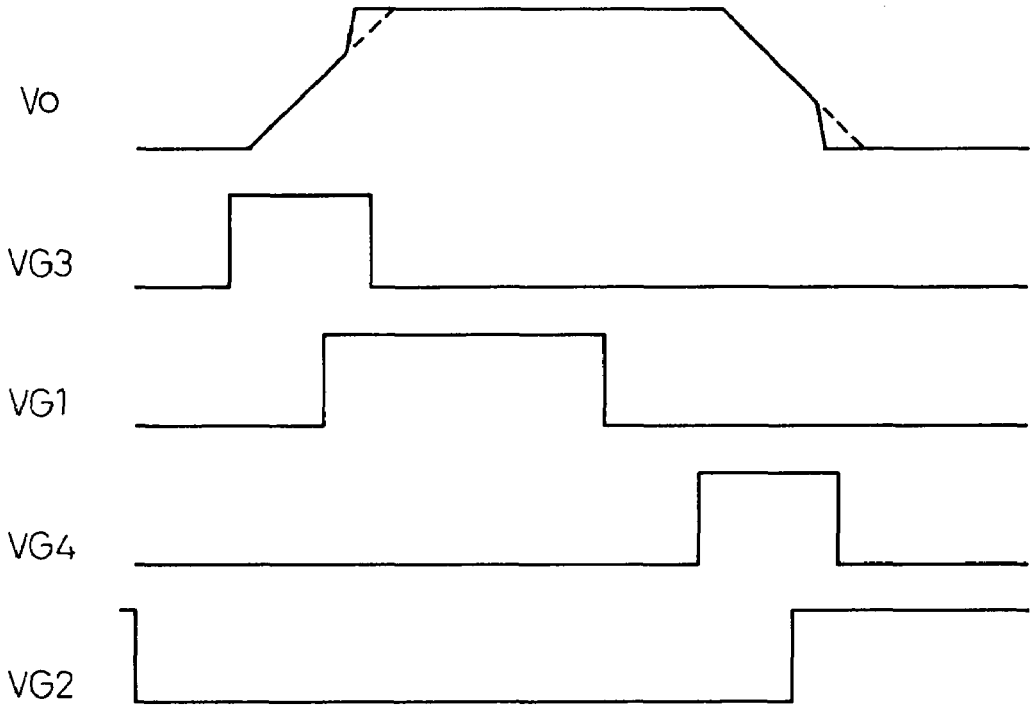
FIGS. 6A and 6B show time charts showing the influence of the shift of the timing in the power recovery circuit.
Figure 6B:
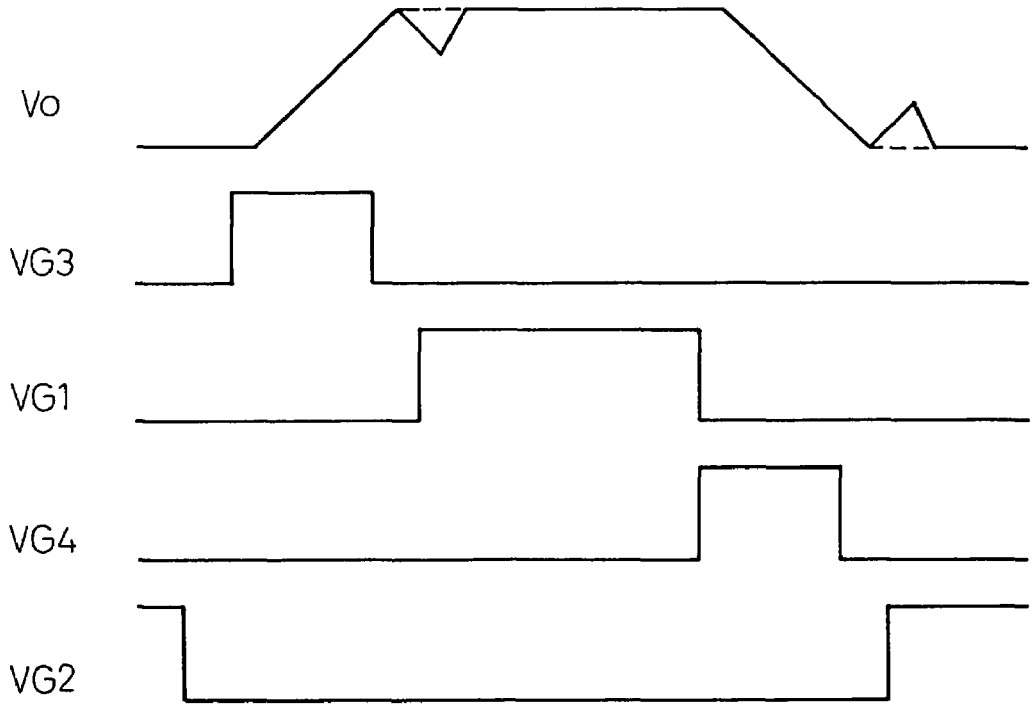
Figure 8:
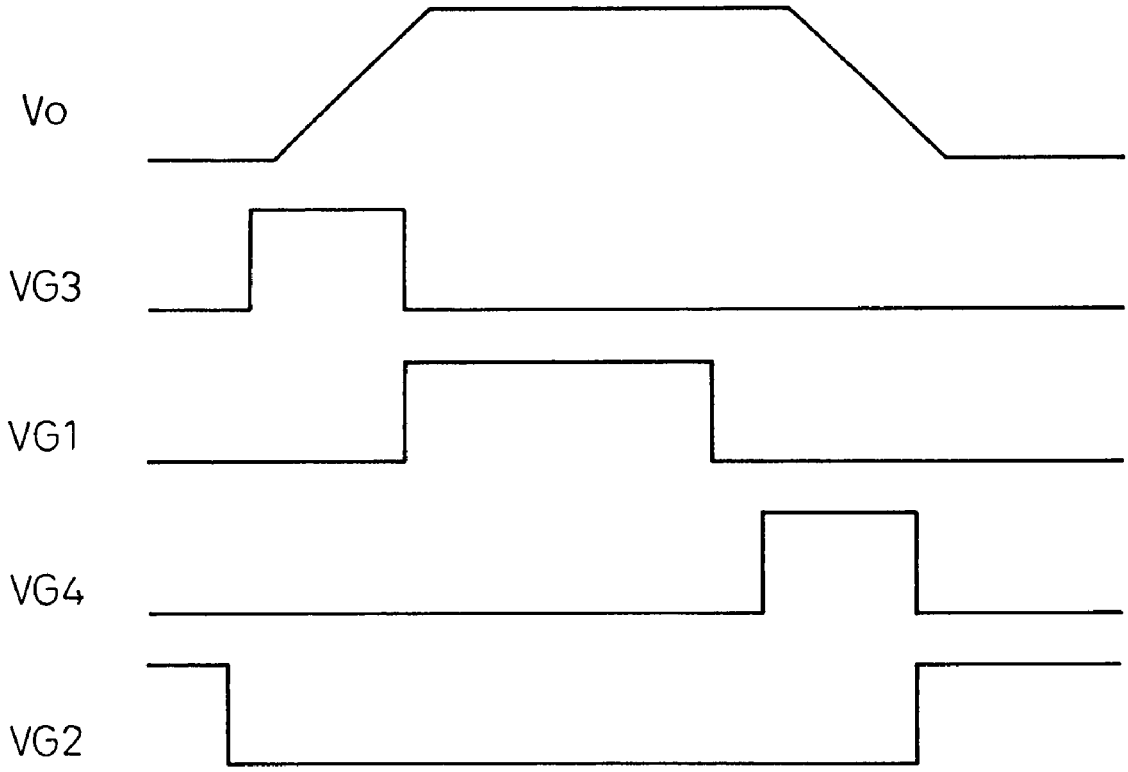
FIG. 8 is a time chart showing the operation of the sustaining circuit in the embodiment.

The sustaining circuit in the embodiments is different from the structure as shown in FIG. 3 in that the first phase adjusting circuit 51 through the fourth phase adjusting circuit 54 are provided in the former stage of each drive circuit 32, 34, 38, and 41. Even though the delay times of the output devices 31, 33, 37, and 40, and those of the drive circuits 32, 34, 38, and 41 are dispersed, it is still possible to achieve the optimized state of the on/off timing of the output devices 31, 33, 37, and 40 as shown in FIG. 8 by adjusting the delay in the first phase adjusting circuit 51 through the fourth phase adjusting circuit 54.

Figure 9:
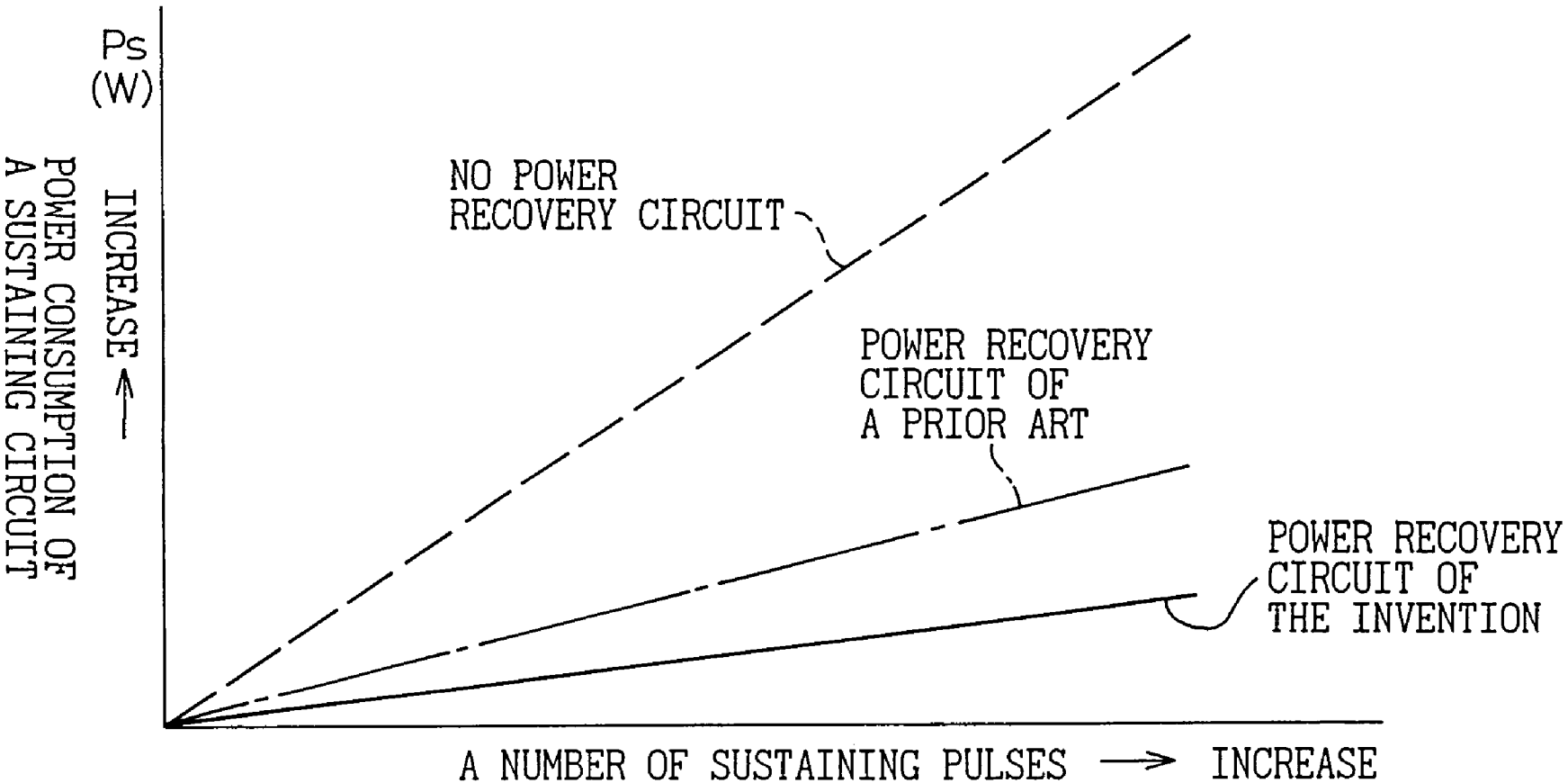
FIG. 9 is a schematic showing the effect of decreasing the power consumption of the present invention.

FIG. 9 is a schematic showing the effect of decreasing the power consumption in the present invention. As shown schematically, the power consumption increases in proportion to the number of sustaining pulses in the sustaining circuit. The constant of proportion of the increase is the largest when the power recovery circuit is not employed and it can be decreased considerably by employing the power recovery circuit as shown in FIG. 3, and it can be decreased furthermore and the power consumption is decreased by employing the present invention.

Figure 10:
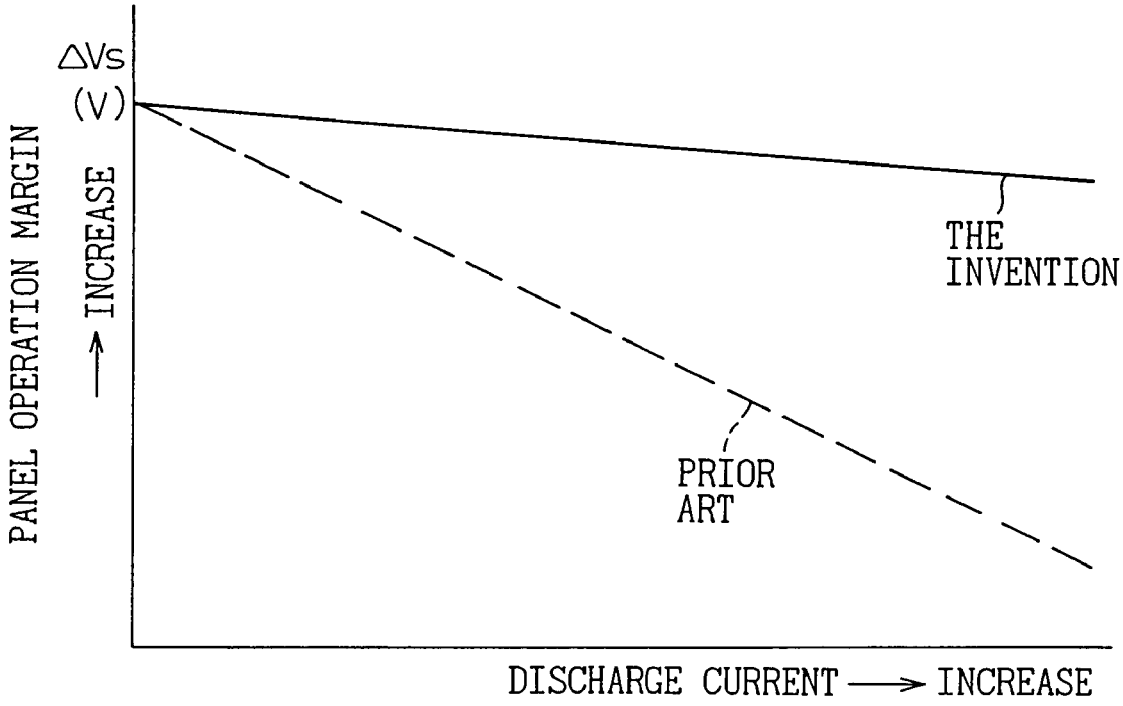
FIG. 10 is a schematic showing the effect of increasing the operation margin in the ALIS system of the present invention.

FIG. 10 is a schematic showing the improved effect of the operation margin of the present invention. The difference Δ Vs of the maximum value Vs (max) and the minimum value Vs (min) of the aforementioned operating voltage is used as the operation margin. As shown schematically, as the discharge current increases the operation margin decreases, but the decrease of the operation margin is smaller compared to the structure in FIG. 3 when the present invention is applied.

Figure 11A:
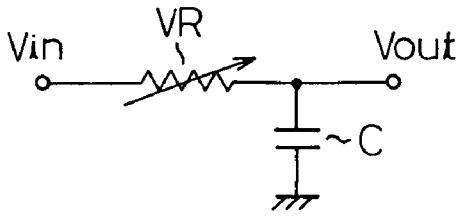
FIGS. 11A through 11P show schematics showing examples of the phase adjusting circuits in the embodiments.
Figure 11B:
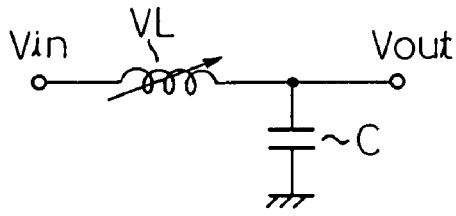
Figure 11C:
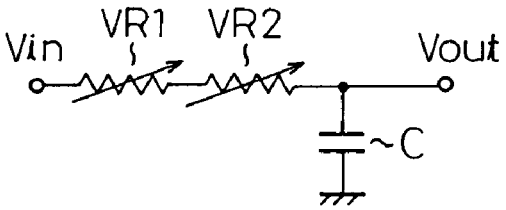
Figure 11D:
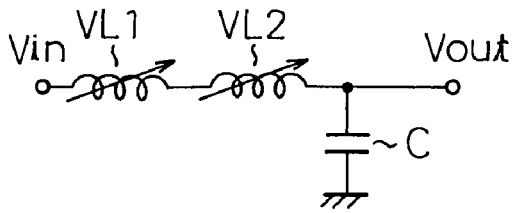
Figure 11E:
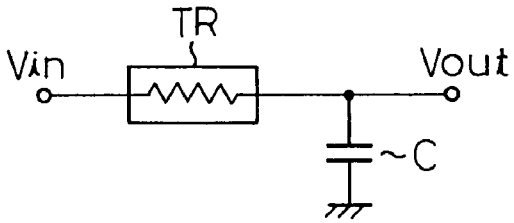
Figure 11F:
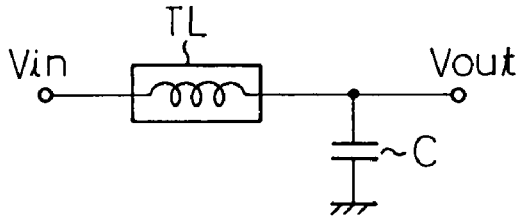
Figure 11G:
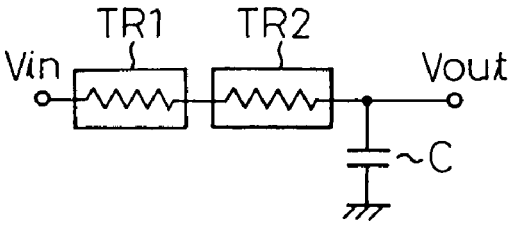
Figure 11H:
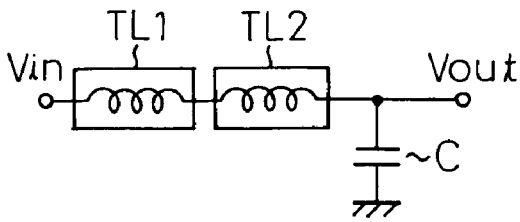
Figure 11I:
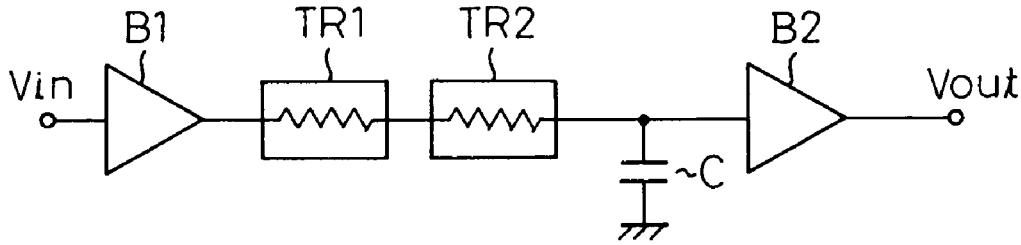
Figure 11J:
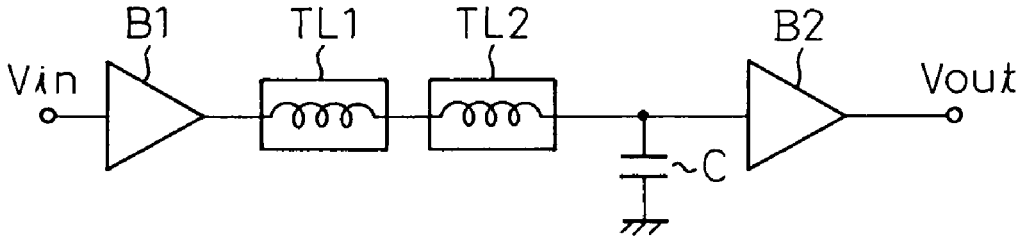
Figure 11K:
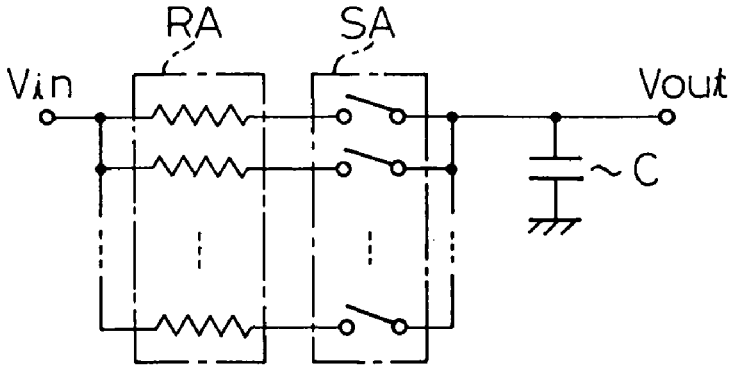
Figure 11L:
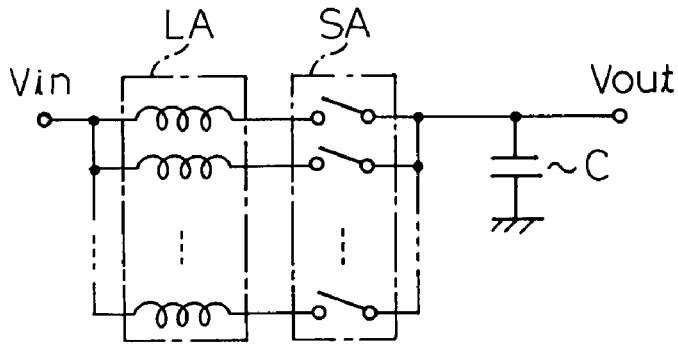
Figure 11M:
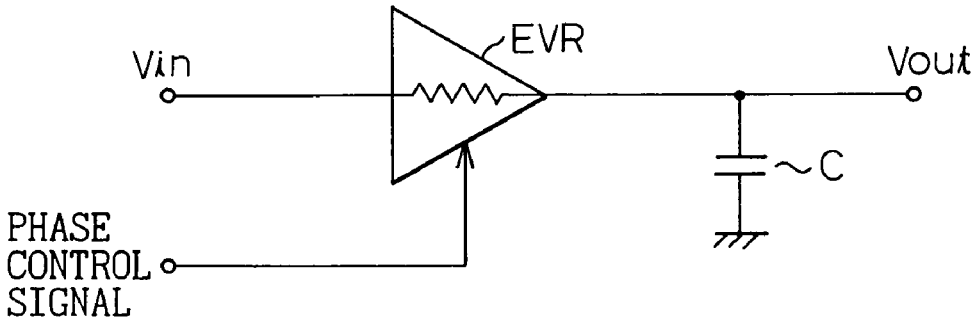
Figure 11N:
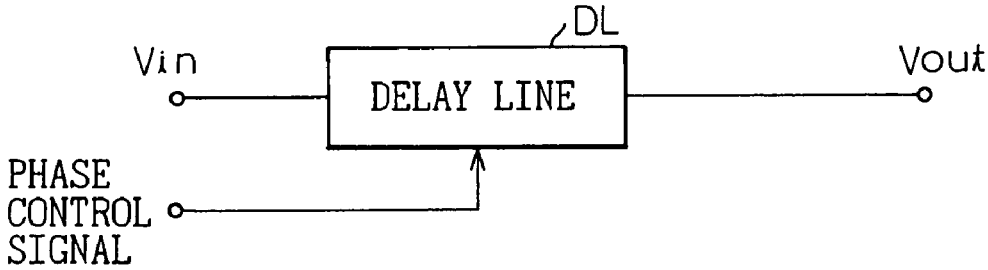
Figure 110:
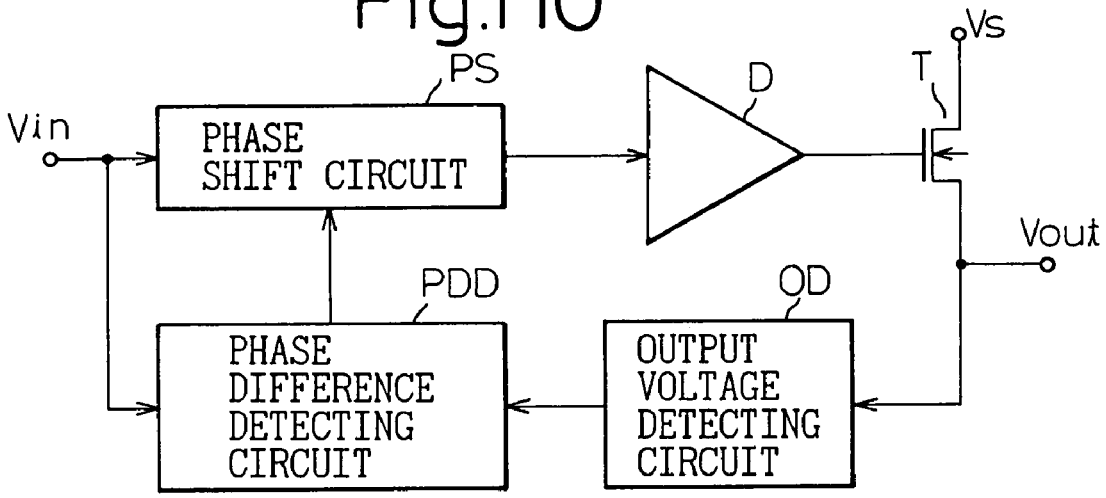
Figure 11P:
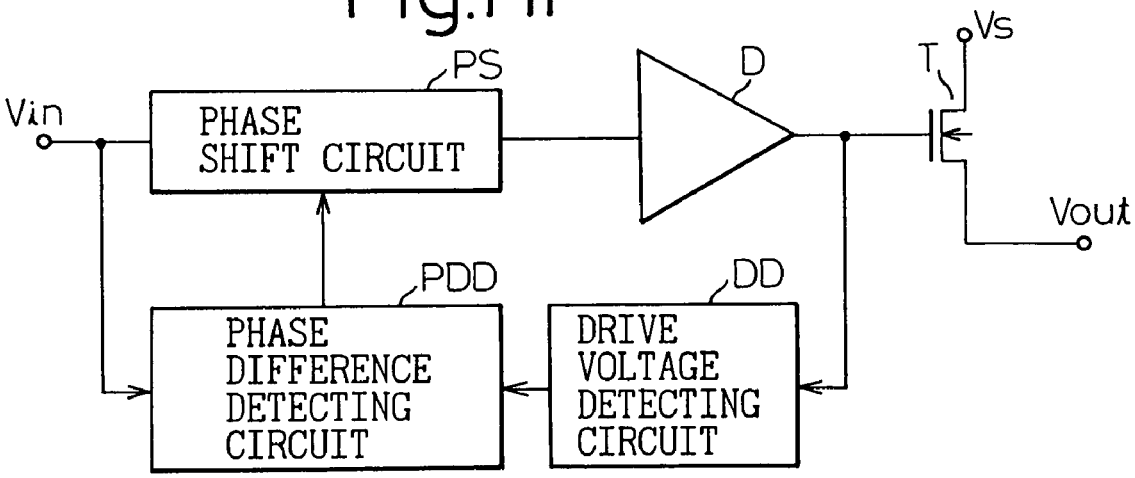

The circuit structure of the phase adjusting circuit is described next. The phase adjusting circuit is used to adjust the delay time of a signal and various delay circuits are widely known and available to use. FIGS. 11A through 11P are schematics showing the phase adjusting circuits. FIG. 11A shows a delay circuit consisting of a variable resistor VR and a capacitor C, FIG. 11B shows that of a variable inductor VL and capacitor C, FIG. 11C shows that of a variable resistor VR1 for coarse adjustment, a variable resistor VR2 for fine adjustment, and a capacitor C, FIG. 11D shows that of a variable inductor VL1 for coarse adjustment, a variable inductor VL2 for fine adjustment, and a capacitor C, FIG. 11E shows that of a resistor TR of which resistance value can be adjusted by trimming and a capacitor C, FIG. 11F shows that of an inductor TL of which inductance value can be adjusted by trimming and a capacitor, FIG. 11G shows that of a trimming resistor TR1 for coarse adjustment, a trimming resistor TR2 for fine adjustment, and a capacitor C, FIG. 11H shows that of a trimming inductor VL1 for coarse adjustment, a trimming inductor VL2 for fine adjustment, and a capacitor C, FIGS. 11I and 11J show circuits that have additional buffer circuits B1 at the inputs and additional buffer circuits B2 at outputs of the circuits, respectively, in FIGS. 11G and 11H, FIG. 11K shows a circuit consisting of a register array RA, a switch array SA, and a capacitor C, in which RA and SA collaborate in generating a selected resistance value, FIG. 11L shows that of an inductor array LA, a switch array SA, and a capacitor C, in which LA and SA collaborate in generating a selected inductance value, FIG. 11M shows a circuit equipped with an electronic variable resistor EVR, of which resistance value can be set from the outside by the phase control signal, and a capacitor C, FIG. 11N show a circuit equipped with a delay line DL, which can select the delay using the phase control signal, FIG. 110 shows a circuit, in which a phase shift circuit PS is provided before a drive circuit D, the actual output Vout of an output device T is detected in an output voltage detection circuit OD, the phase difference is determined from the input signal Vin and the detected result of the output voltage detection circuit OD in a phase difference detecting circuit, and the delay of the phase shift circuit PS is adjusted accordingly, and FIG. 11P shows a circuit that differs from FIG. 110 only in that a drive voltage detecting circuit DD, which detects the output of the drive circuit D, is employed instead of the output voltage detection circuit OD, and the delay time of the output device T cannot be adjusted in this circuit. Though not shown here, a variable capacitor C of which the capacitance can be changed may also be used.

Next, the process of adjusting and setting each phase adjusting circuit of each sustaining circuit in the embodiments is described.

Figure 12:
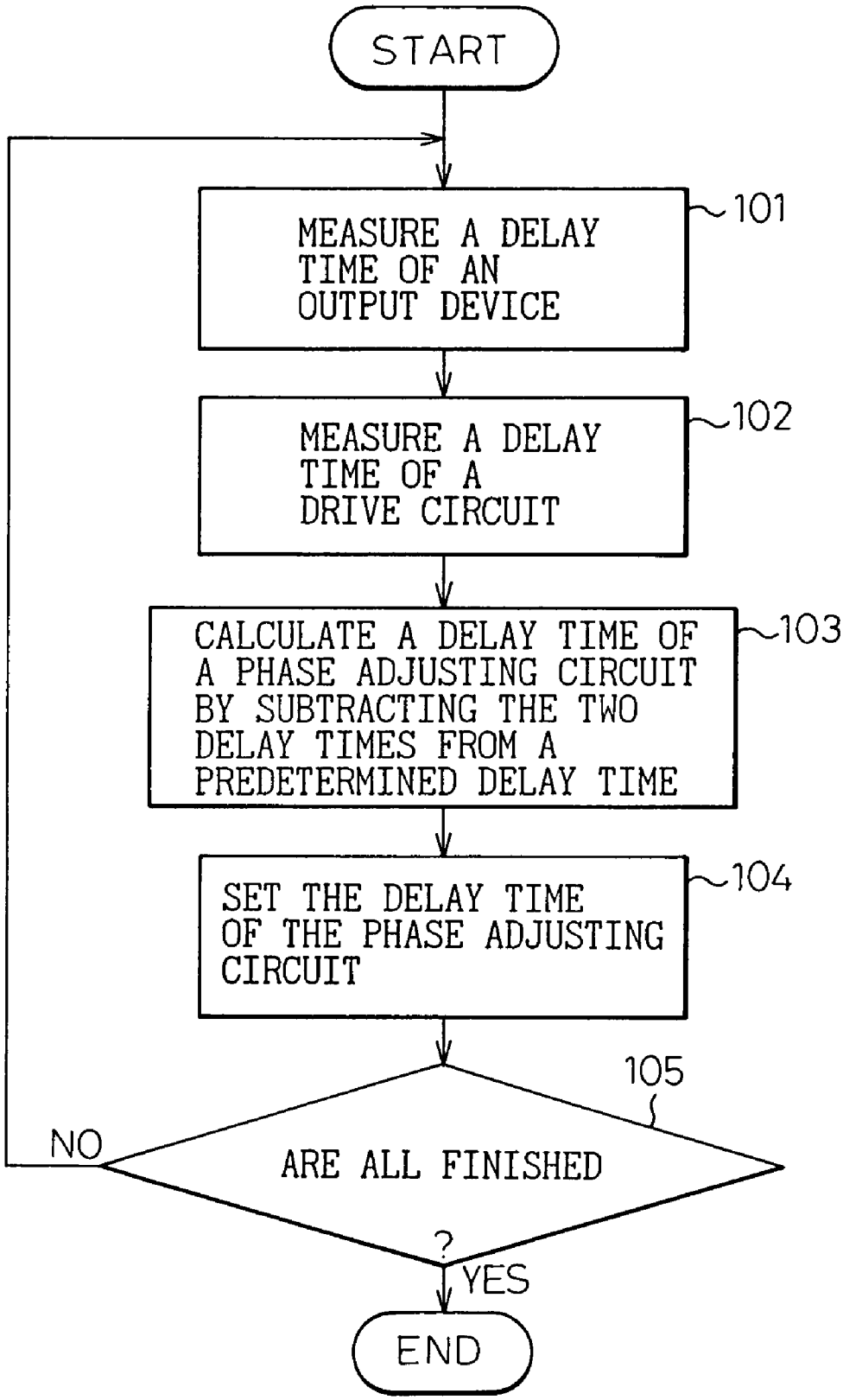
FIG. 12 is a flow chart showing the process of setting the phase adjusting circuit.

FIG. 12 is a flow chart showing the process of setting the phase adjusting circuit. A delay time of an output device is measured in step 101, a delay time of a drive circuit, which is used with the above-mentioned output device, is measured in step 102, a delay time of a phase adjusting circuit to be used together is calculated by subtracting the above-mentioned two delay times from a predetermined delay time in step 103, and the delay time of the phase adjusting circuit to be used together is set based on the calculated delay time in step 104. Such a process is applied to all sets. As a result, each output device turns on or off with a predetermined timing. Therefore, the power consumption can be reduced to the minimum and erroneous charge and malfunctions can be avoided.

Figure 13:
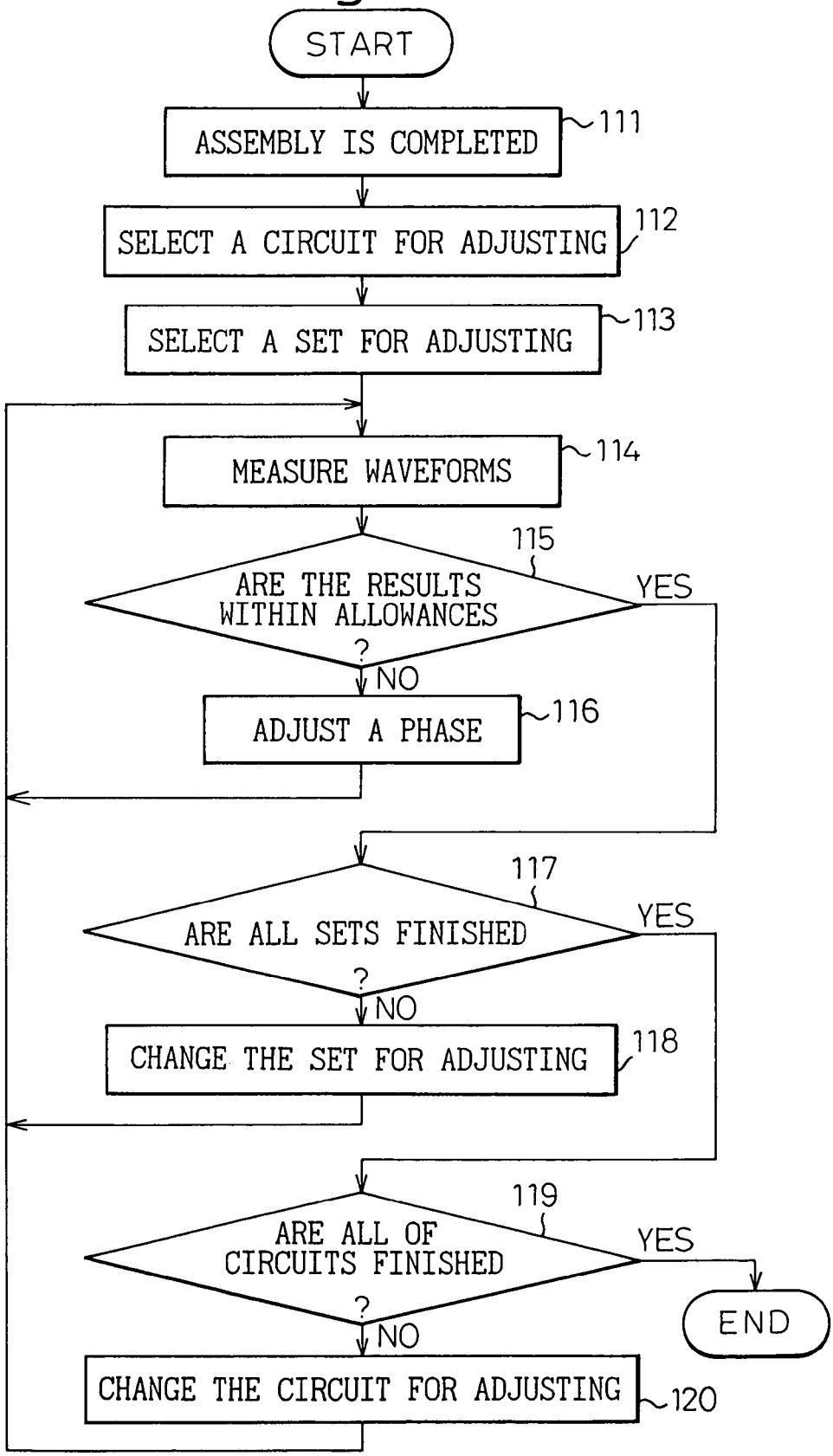
FIG. 13 is a flow chart showing the process of setting the phase adjusting circuit with the variations in characteristics of the PDP taken into account.

The process shown in FIG. 12 compensates for variation in delay times of the output devices and the drive circuits and is performed before the sustaining circuit is set to the PDP apparatus. It is preferable, however, to optimize the timing of the sustaining pulses according to the PDP apparatus because there may be a variation in capacitances between electrodes of the PDP apparatus depending on manufacturing process, changing the time constant of the oscillation circuit in the power recovery circuit. FIG. 13 is a flow chart showing a process of setting the delayed time of the phase adjusting circuit to the optimum value, with the variation in the PDP apparatuses driven by the sustaining circuit taken into account.

In step 111, the sustaining circuit is assembled while being set to the device including the PDP apparatus. In this step, just an operating status is required, not a complete assembly. In step 112, a circuit for adjusting is selected among from the first X sustaining circuit 18-O, the second X sustaining circuit 18-E, the first Y sustaining circuit 19-O, and the second X sustaining circuit 18-E. In step 113, a set for adjusting is selected, to be more specific, a phase adjusting circuit for adjusting is selected among from the first through the fourth phase adjusting circuits 51 through 54. In step 114, the waveforms relating to the selected sets of the PDP apparatus are measured, in step 115, whether or not the results are within allowances with respect to the specified reference signal is checked, and if the results are not within allowances, the phase adjusting circuit is adjusted in step 116, and steps 114 through 116 are repeated until the results are within allowances.

In step 117, whether the above-mentioned process is finished for all sets is determined, and if not, the set for adjusting is changed in step 118 and the procedure returns to step 114. As explained above, the adjustment of the four phase adjusting circuits of the circuit for adjusting is completed, and the sustaining pulses put out of the circuit turn on and off with a predetermined timing. In addition, in step 119, whether the above-mentioned process is completed for all of circuits is determined, and if not, the circuit for adjusting is changed in step 120 and the procedure returns to step 114. Finally the adjustment for all of circuits is completed.

Figure 14:
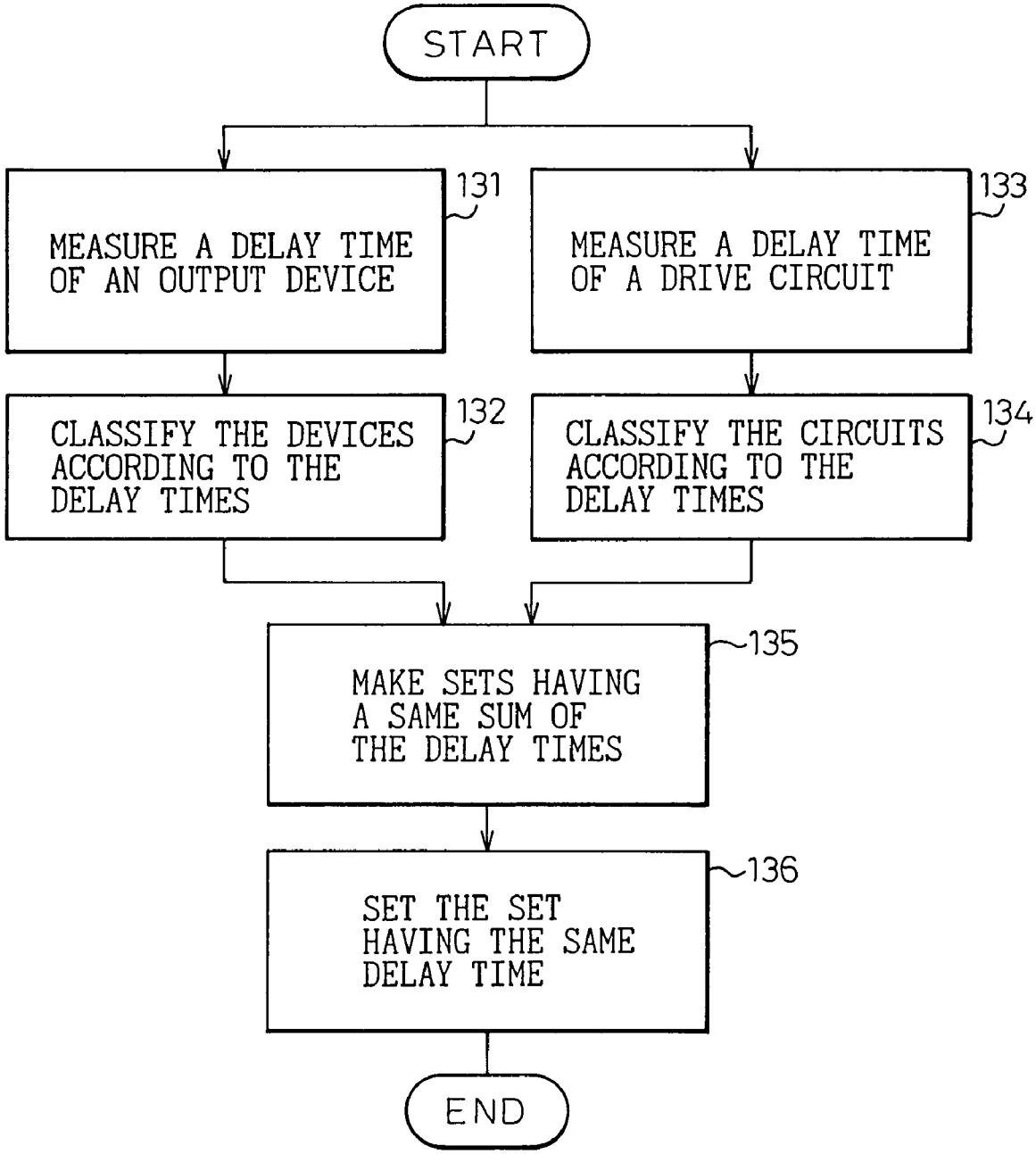
FIG. 14 is a flow chart showing the manufacturing method of combining the circuit devices, which have been classified in advance according to the delay times, in the sustaining circuit.

Though the phase adjusting circuits are provided in the embodiment described above, the timing of the sustaining pulse can be optimized by measuring the delay times of circuit devices to be used in the sustaining circuit, selecting a set in which the sum of delay times are within the allowances or, to be more specific, a set in which the sum of the delay times of the output devices and the drive circuit are within the allowances with respect to a predetermined value, and setting the set to the PDP apparatus. FIG. 14 is a flow chart showing the manufacturing process mentioned above.

In step 131, a delay time of an output device is measured, and the devices are classified according to the delay times in step 132. In parallel with this process, a delay time of a drive circuit is measured in step 133 and the circuits are classified according to the delay times in step 134. With the above-mentioned process steps, the output devices and the drive circuits are classified according to the delay times.

In step 135, sets are made so that the sum of the delay times for each set is equal. For example, a PDP apparatus employing the ALIS system has four sustaining circuits, and each sustaining circuit has four sets of the output device and the drive circuit. That is, it is necessary to selects 16 sets with the same sum of delay times because the PDP apparatus has 16 sets of the output device and the drive circuit. The sets of the output device and the drive circuits are set in step 136.

Figure 15:
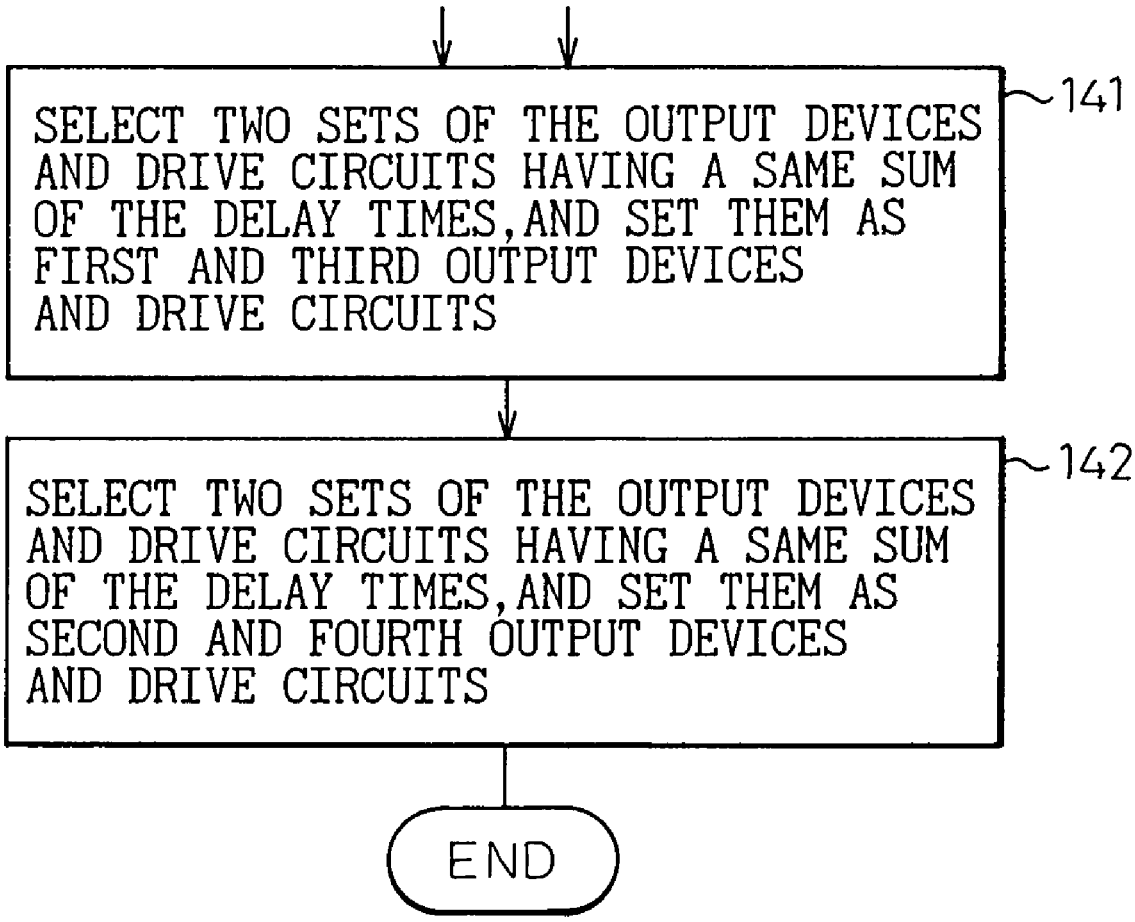
FIG. 15 is a flow chart showing the manufacturing method when only the increase of the power recovery rate is aimed.

In the process mentioned above, though the 16 sets are selected for the sustaining circuit of a PDP apparatus so that the sum of delay times is equal for each of the sets, it is only required for the on/off timing of the output devices 31 and 34, and that of the output devices 33 and 37 to be in the specified relation for each sustaining circuit in order to improve the power recovery rate. FIG. 15 is a flow chart showing the manufacturing process in this case.

After steps 131 through 134 as shown in FIG. 14, two sets of the output device and the drive circuit with the same sum of delay times are selected and set as the first output device 31 and drive circuit 32, and the third output device 40 and drive circuit 53 in step 141. Similarly, two sets of the output device and the drive circuit with the same sum of delay times are selected and set as the second output device 33 and drive circuit 34, and the fourth output device 37 and drive circuit 54 in step 142.

In order to prevent erroneous discharge in the ALIS system, there should be no difference in on/off timing when the sustaining pulse is applied between two adjacent electrodes. That is, there should be no difference in timing between the sustaining pulses put out of the first X sustaining circuit and applied to the odd-numbered X electrodes and those put out of the first and the second Y sustaining circuits and applied to the odd-numbered and even-numbered Y electrodes, and also there should be no difference in timing between the sustaining pulses put out of the second X sustaining circuit and applied to the even-numbered X electrodes and those put out of the first and the second Y sustaining circuits and applied to the odd-numbered and the even-numbered Y electrodes. This eventually means that there is no difference in timing between every sustaining pulse. According to the results of the investigation of the timing difference with which no erroneous discharge is caused in the PDP apparatus employing the ALIS system, the occurrence rate of erroneous discharge is small when the difference between the sustaining pulses applied to the adjacent electrodes is within ±30 ns.

Figure 16:
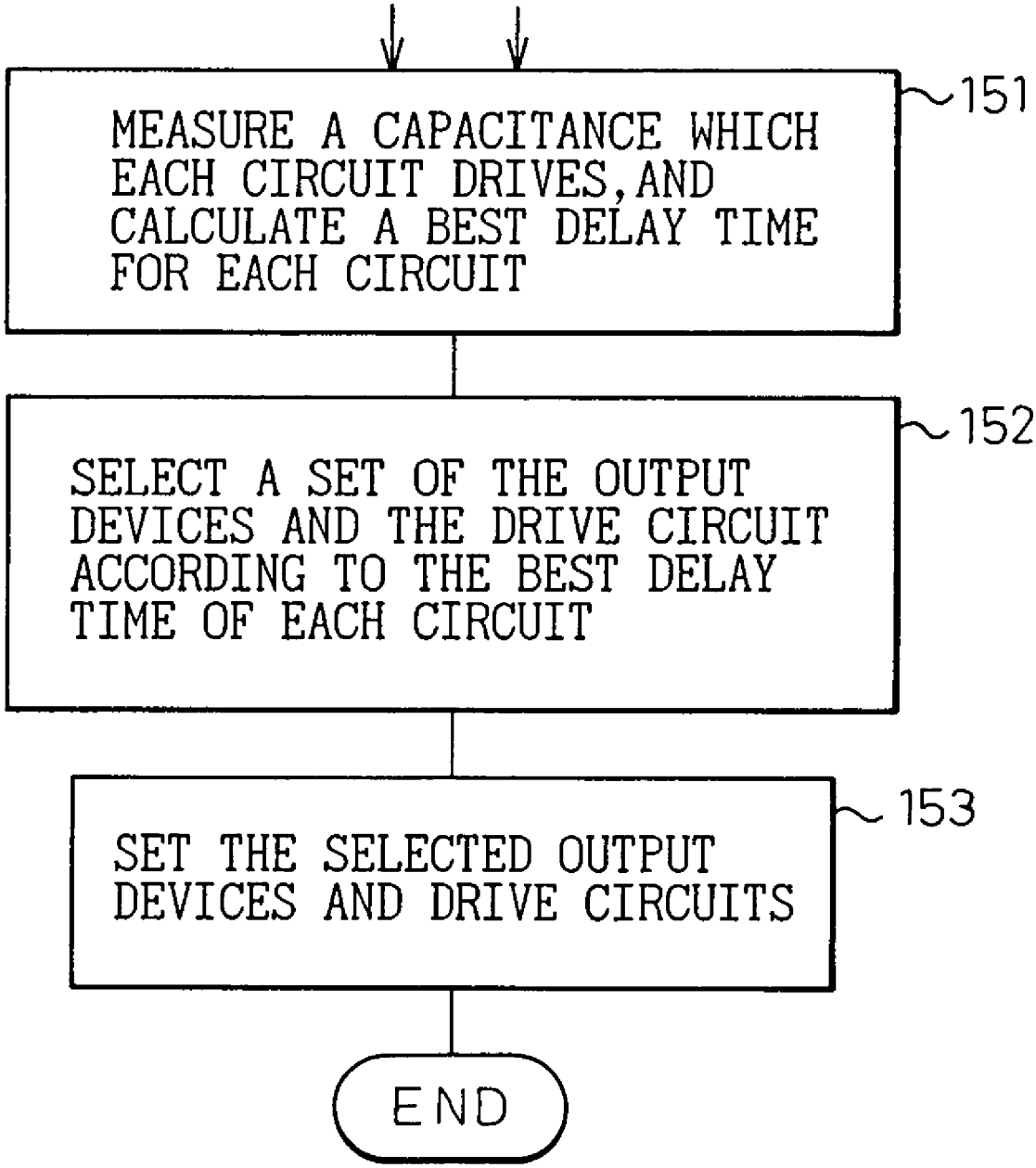
FIG. 16 is a flow chart of the manufacturing method when the variations in characteristics of the PDP are taken into account.

Even when the sets are selected after the delay time is measured, it is advisable to take the variation in capacitance into account. FIG. 16 is a flow chart showing the manufacturing process in this case.

In step 151, the capacitance of the PDP, which the sustaining circuit drives, is measured, and the best delay time of the sustaining circuit to be set thereto is calculated. In step 152, a set of the classified output device and drive circuit is selected so that the delay time is optimized and is set in step 153.

Though the embodiments of the present invention are described above, if there are some other circuit devices that cause a delay in the sustaining pulse, it is matter of course that the delay time of them should be taken into account.

As explained above, according to the present invention, the on/off timing of the sustaining pulse that is influenced by the variation in delay time of the drive circuit in the sustaining circuit and that of the output devices, and the on/off timing of the output devices of the power recovery circuit can be optimized, therefore, the variation in power recovery rate in each PDP apparatus can be reduced, the power consumption on average can be also reduced, and the variation in operation margin can be improved, and moreover, the possibility of occurrence of erroneous discharge can be reduced in the ALIS system.

What is claimed is:

1. A plasma display apparatus, comprising:

a plasma display panel equipped with first electrodes and second electrodes arranged adjacently to each other, extending in a first direction, and address electrodes extending in a second direction at a right angle to the first direction;

an X sustaining circuit that supplies sustaining pulses to said first electrodes;

a Y sustaining circuit that supplies sustaining pulses to said second electrodes;

each of said X and Y sustaining circuits further comprising:

a first output device provided between a path connected to said first or second electrodes and a high potential power supply, a second output device provided between the path connected to said first or second electrodes and a low potential power supply, the first and the second output devices respectively being connected between a path through which the sustaining pulses are supplied and a high voltage power source line, and between the path and a low voltage power source line, a power recovery circuit having a resonant circuit, formed with a display capacitor of the plasma display panel, which recovers energy when an application of the sustaining pulse is released and uses the recovered energy for a next application of the sustaining pulse;

a third output device that switches a connection state of the path and the power recovery circuit to a state in which power is supplied from the power recovery circuit to the path, a fourth output device that switches the connection state of the path and the said power recovery circuit to a state in which power is recovered from the path to the power recovery circuit, a first drive circuit through a fourth drive circuit that drive the first through the fourth output devices, respectively, a first phase adjusting circuit that adjusts timing of a changing edge of a driving signal which drives said first output device;

a second phase adjusting circuit that adjusts timing of a changing edge of a driving signal which drives said second output device; and a third phase adjusting circuit adjusting a time difference between a turning on of the third output device and that of the first output device, and a time difference between a turning on of the fourth output device and that of the second output device.

2. The plasma display apparatus, as set forth in claim 1, wherein the first phase adjusting circuit, the second phase adjusting circuit, the third phase adjusting circuit and the fourth phase adjusting circuit are provided at a stage preceding the first drive circuit through the fourth drive circuit, respectively.

3. The plasma display apparatus, as set forth in claim 1, wherein the adjustment by said first phase adjusting circuit is independent of the adjustment by said second phase adjusting circuit.

4. A plasma display apparatus, comprising:

a plasma display panel equipped with first electrodes and second electrodes arranged adjacently to each other, extending in a first direction, and address electrodes extending in a second direction at a right angle to the first direction, wherein the plasma display panel forms a first display line between one side of one of the second electrodes and one adjacent electrode of the first electrodes, a second display line between another side of the one second electrode and another adjacent electrode of the first electrodes, and forms a display field of a frame by plural subfields, and provides a gray scale by combining said subfields selectively for display;

an X sustaining circuit that supplies sustaining pulses to said first electrodes, the X sustaining circuit being equipped with a first X sustaining circuit that supplies the sustaining pulse to an odd-numbered electrode of the first electrodes, and a second X sustaining circuit that supplies the sustaining pulse to an even-numbered electrode of the first electrodes;

a Y sustaining circuit that supplies sustaining pulses to said second electrodes, the Y sustaining circuit comprising a first Y sustaining circuit that supplies the sustaining pulse to an odd-numbered electrode of the second electrodes, and a second Y sustaining circuit that supplies the sustaining pulse to an even-numbered electrode of the second electrodes;

each of said X and Y sustaining circuits further comprising:

a first output device provided between a path connected to said first or second electrodes and a high potential power supply;

a second output device provided between the path connected to said first or second electrodes and a low potential power supply;

a first phase adiusting circuit that adjusts timing of a changing edge of a driving signal which drives said first output device;

a second phase adiusting circuit that adjusts timing of a changing edge of a driving signal which drives said second output device; and wherein a difference in rising or falling timing between the sustaining pulse output by the first X sustaining circuit and that output by the first or the second Y sustaining circuit, and a difference in rising or falling timing between the sustaining pulse output by the second X sustaining circuit and that output by the first or the second Y sustaining circuit are adjusted so that the differences of the timings are within a predetermined range of ±30 ns.

5. The plasma display apparatus, as set forth in claim 4, wherein the adjustment by said first phase adjusting circuit is independent of the adjustment by said second phase adjusting circuit.

6. A manufacturing method of a plasma display apparatus comprising a plasma display panel having first electrodes and second electrodes arranged adjacently to each other, extending in a first direction, and address electrodes extending in a second direction at a right angle to the first direction, an X sustaining circuit that supplies a sustaining pulse to said first electrodes, and a Y sustaining circuit that supplies a sustaining pulse to said second electrodes, wherein signal delay times of circuit devices which form the X sustaining circuit and the Y sustaining circuit are measured and the circuit devices are classified according to the respective signal delay times;

sets of the classified circuit devices are selected so that a timing of a changing edge of each said sustaining pulse falls within a predetermined allowance and the sets of selected circuit devices are provided for the plasma display apparatus;

said plasma display panel forms a first display line between one side of one of the second electrodes and one adjacent electrode of the first electrodes, forms a second display line between another side of the one second electrode and another adjacent electrode of the first electrodes, forms a display field of a frame by plural subfields, and provides a gray scale by combining said subfields selectively for display;

the X sustaining circuit is equipped with a first X sustaining circuit that supplies the sustaining pulse to an odd-numbered electrode of the first electrodes, and a second X sustaining circuit that supplies the sustaining pulse to an even-numbered electrode of the first electrodes;

the Y sustaining circuit is equipped with a first Y sustaining circuit that supplies the sustaining pulse to an odd-numbered electrode of the second electrodes, and a second Y sustaining circuit that supplies the sustaining pulse to an even-numbered electrode of the second electrodes; and a difference in rising or falling timing between the sustaining pulse output by the first X sustaining circuit and that output by the first or the second Y sustaining circuit, and a difference in rising or falling timing between the sustaining pulse output by the second X sustaining circuit and that output by the first or the second Y sustaining circuit are adjusted so that the differences of timings are within a predetermined range, when the circuit devices of the first and second X sustaining circuits and the first and second Y sustaining circuits are selected.

7. A plasma display apparatus having a plasma display panel with first electrodes and second electrodes arranged adjacently to each other, extending in a first direction, and address electrodes extending in a second direction at a right angle to the first direction, comprising:

X and Y sustaining circuits supplying sustaining pulses to said first electrodes and said second electrodes, respectively, wherein each of said X and Y sustaining circuits comprises:

a first output device, a second output device, the first and second output devices of respective X and Y sustain circuits generating sustaining pulses, a first phase adiusting circuit adiusting timing of a changing edge of a first driving signal which drives said first output device, a second phase adiusting circuit to adjust timing of a changing edge of a second driving signal which drives said second output device, and a power recovery circuit having a resonant circuit formed with a display capacitor of the plasma display panel to recover energy of an applied sustaining pulse for an application in a subsequent sustaining pulse, and one of a first connection between a high voltage power source line and the first and the second output devices and a second connection between a low voltage power source line and the first and the second output devices to supply and recover energy from the sustaining pulses.

8. The plasma display apparatus, as set forth in claim 7, wherein the X sustaining circuit and the Y sustaining circuit, respectively, further comprise:

a first drive circuit through a fourth drive circuit that drive the first output device through the fourth output device, respectively; and a phase adjusting circuit to adjust a time difference between a beginning of an on-state of the third output device and a beginning of an on-state of the first output device, and a time difference between a beginning of an on-state of the fourth output device and a beginning of an on-state of the second output device.

9. The plasma display apparatus, as set forth in claim 8, wherein the phase adjusting circuit comprises the first phase adjusting circuit, the second phase adjusting circuit, a third phase adjusting circuit and a fourth phase adjusting circuit provided at a stage preceding the first drive circuit through the fourth drive circuit, respectively.

10. The plasma display apparatus, as set forth in claim 7, wherein the adjustment by said first phase adjusting circuit is independent of the adjustment by said second phase adjusting circuit.

11. A plasma display apparatus, comprising:

a plasma display panel equipped with first electrodes and second electrodes arranged adjacently to each other, extending in a first direction, and address electrodes extending in a second direction at a right angle to the first direction;

an X sustaining circuit that supplies sustaining pulses to said first electrodes;

a Y sustaining circuit that supplies sustaining pulses to said second electrodes;

said X and Y sustaining circuits, further, respectively comprising:

a first output device provided between a path connected to said first or second electrodes and a high potential power supply;

a second output device provided between the path connected to said first or second electrodes and a low potential power supply;

a first phase adiusting circuit that adjusts timing of a changing edge of a driving signal which drives said first output device, wherein the first phase adjusting circuit phase-shifts the first driving signal which drives said first output device; and a second phase adiusting circuit that adjusts timing of a changing edge of a driving signal which drives said second output device; by phase-shifting the second driving signal which drives said second output device.

12. The plasma display apparatus, as set forth in claim 11, wherein:

the first phase shifting circuit comprises:

a first output signal detecting circuit to detect an output of the first output device, and a first phase difference detecting circuit determining the phase difference between the first driving signal and the output of the first output device to adjust the phase delay of the first phase adjusting circuit for a delay time of the first output device; and the second phase shifting circuit comprises:

a second output signal detecting circuit to detect an output of the second output device, and a second phase difference detecting circuit determining the phase difference between the second driving signal and the output of the second output device to adjust the phase delay of the second phase adjusting circuit for a delay time of the second output device.

13. The plasma display apparatus, as set forth in claim 11, wherein the adjustment by said first phase adjusting circuit is independent of the adjustment by said second phase adjusting circuit.

14. A plasma display apparatus, comprising:

a plasma display panel equipped with first electrodes and second electrodes arranged adjacently to each other, extending in a first direction, and address electrodes extending in a second direction at a right angle to the first direction;

an X sustaining circuit that supplies sustaining pulses to said first electrodes using a first drive signal;

a Y sustaining circuit that supplies sustaining pulses to said second electrodes using a second driving signal, wherein each of said X and Y sustaining circuits comprises:

a first phase adjusting circuit to adjust timing of a changing edge of a first driving signal, and outputting a first timing adjusted driving signal, a second phase adjusting circuit to adjust timing of a changing edge of a second driving signal, and outputting a second timing adjusted driving signal, a first output device turning on and turning off in response to the first timing adjusted driving signal, and provided between a path connected to said first electrode or said second electrode and a high potential power supply, a second output device turning on and turning off in response to the second timing adjusted driving signal, and provided between the path connected to said first electrode or said second electrode and a low potential power supply, the first and second output devices producing and outputting the sustaining pulses by reciprocally and alternatingly turning on and turning off, a power recovery circuit employing a capacitance of the plasma display panel to recover energy when a first application of the sustaining pulses occurs and to supply the recovered energy in a next application of the sustaining pulses, a third output device to switch a connection state of the power recovery circuit to a state in which power is supplied from the power recovery circuit to the capacitance of the plasma display panel, and a fourth output device to switch a connection state of the power recovery circuit to a state in which the power is recovered from the capacitance of the plasma display panel to the power recovery circuit; and the first and second phase adjusting circuits adjusting the timing of the changing edges of the first and second driving signals to prevent any substantial time difference between turning on of the third output device of said respective X or Y sustaining circuit and turning on of the first output device thereof, and any substantial time difference between a turning on of the fourth output device of said respective X or Y sustaining circuit and a turning on of the second output device of said respective X or Y sustaining circuit.

15. The plasma display apparatus, as set forth in claim 14, wherein the time difference is within +30 ns.

* * * * *

UNITED STATES PATENT AND TRADEMARK OFFICE

CERTIFICATE OF CORRECTION

PATENT NO. : 7,224,329 B1
APPLICATION NO. : 09/702889
DATED : May 29, 2007
INVENTOR(S) : Makoto Onozawa et al.

It is certified that error appears in the above-identified patent and that said Letters Patent is hereby corrected as shown below:

Title Page, Column 2, Item [57] (Abstract), Line 9, after “pulse” insert --.--.

Column 12, Line 7, Claim 4, change “adiusting” to --adjusting--.

Column 12, Line 10, Claim 4, change “adiusting” to --adjusting--.

Column 13, Line 20, Claim 7, change “adiusting circuit adiusting” to --adjusting circuit adjusting--.

Column 13, Line 23, Claim 7, change “adiusting” to --adjusting--.

Column 14, Line 11, Claim 11, change “adiusting” to --adjusting--.

Column 14, Line 16, Claim 11, change “adiusting” to --adjusting--.

Column 16, Line 15, Claim 15, change “+30 ns.” to --±30 ns.--.

Signed and Sealed this

Second Day of October, 2007

JON W. DUDAS
*Director of the United States Patent and Trademark Office*